US005602629A

United States Patent [19]

Saito et al.

[11] Patent Number: 5,602,629

[45] Date of Patent: Feb. 11, 1997

[54] IMAGE FORMING APPARATUS WITH A PURGE CONTROL MEANS

[75] Inventors: Hisahiro Saito; Hajime Tanaka; Takayuki Miyamoto; Takao Kurohata, all of Hachioji, Japan

[73] Assignee: Konica Corporation, Tokyo, Japan

[21] Appl. No.: 524,507

[22] Filed: Sep. 7, 1995

[30] Foreign Application Priority Data

Sep. 17, 1994 [JP] Japan ..... 6-248900

[51] Int. Cl.[6] ..... G03G 15/09

[52] U.S. Cl. ..... 399/58; 399/98

[58] Field of Search ..... 355/215, 245, 355/298, 246, 259, 261; 118/652, 654, 656; 430/122

[56] References Cited

U.S. PATENT DOCUMENTS

| | | | |
|---|---|---|---|
| 4,436,413 | 3/1984 | Oka | 355/245 |
| 4,739,370 | 4/1988 | Yoshida et al. | 355/296 |
| 5,130,755 | 7/1992 | Ikegawa et al. | 355/296 |
| 5,153,642 | 10/1992 | Folkins et al. | 355/215 |
| 5,231,458 | 7/1993 | Nishimura | 355/298 |
| 5,239,345 | 8/1993 | Kikuchi et al. | 355/259 |
| 5,249,025 | 9/1993 | Nakazawa et al. | 355/297 |
| 5,278,621 | 1/1994 | Okamoto et al. | 355/305 |
| 5,335,051 | 8/1994 | Tani | 355/245 |

OTHER PUBLICATIONS

European Search Report.

*Primary Examiner*—Thu Anh Dang

*Attorney, Agent, or Firm*—Frishauf, Holtz, Goodman, Langer & Chick

[57] ABSTRACT

An image forming apparatus such as a printer or copier includes a photoreceptor for holding a latent image; a charger for charging the photoreceptor; an exposure unit such as an LED array for exposing the photoreceptor with light so as to form a latent image on the photoreceptor; and a developer placed in the vicinity of the photoreceptor, for developing the latent image with a developing agent so as to form a developing agent image on the photoreceptor. The developer includes a developing sleeve for holding the developing agent on its surface and a transferor for transferring the developing agent image on the photoreceptor to a recording medium. A cleaner is provided for cleaning a residual developing agent on the photoreceptor after the developing agent image is transferred to the recording medium and a purge control unit is provided for purging foreign matter from the developing agent on the developing sleeve. The purge control unit includes an attraction member for attracting foreign matter from the developing sleeve.

21 Claims, 25 Drawing Sheets

FIG. 10 ( a )
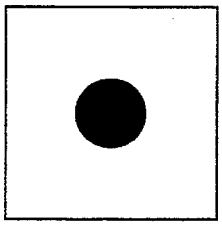
TYPE 1
BACKGROUND PORTION
FIG. 10 ( b )
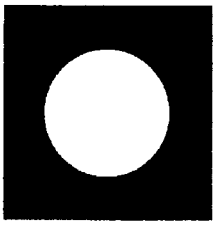
TYPE 2
IMAGE PORTION
FIG. 10 ( c )
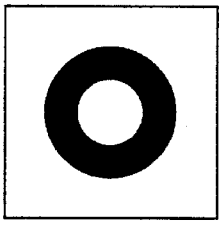
TYPE 3
BACKGROUND PORTION FIG. 11 ( a )
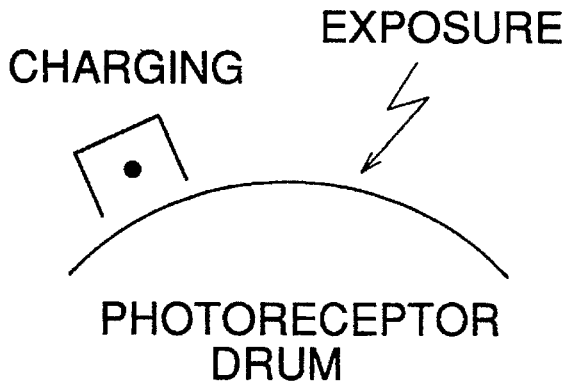
FIG. 11 ( b )
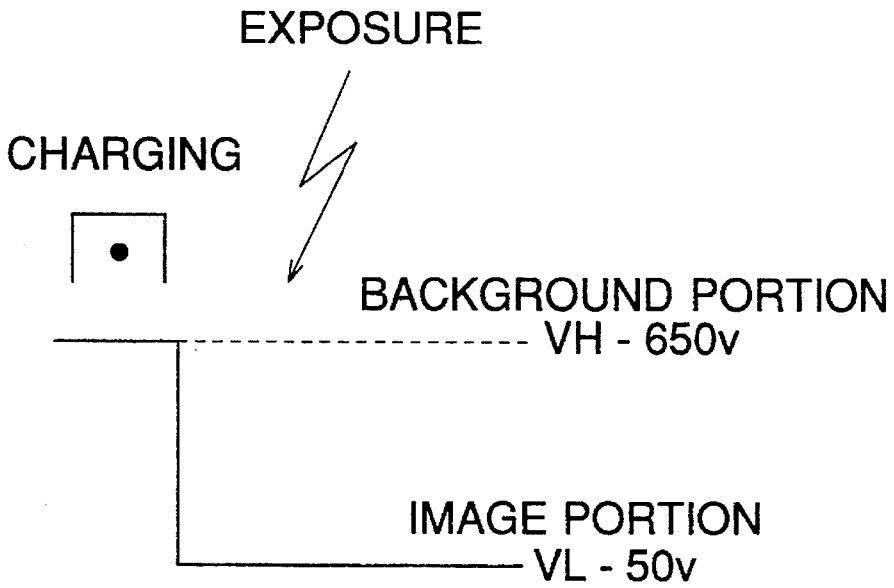

FIG. 12 ( a )
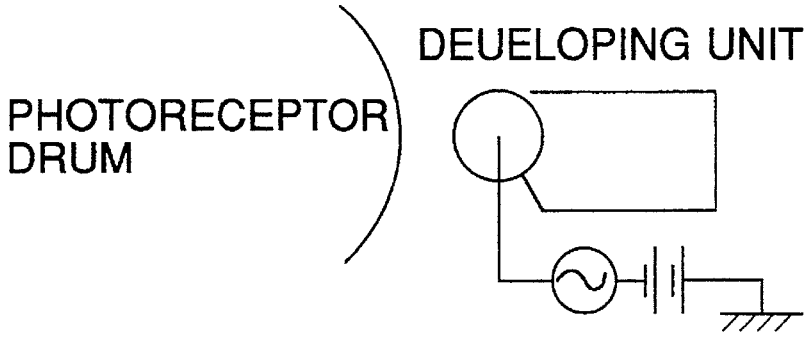
FIG. 12 ( b )
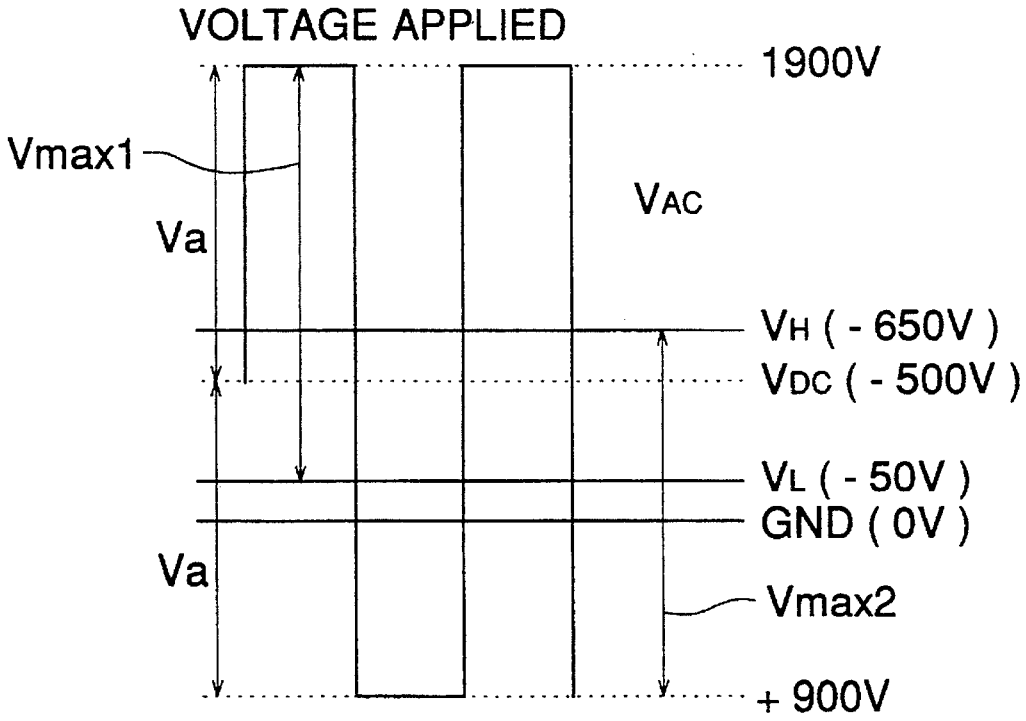

IMAGE FORMING APPARATUS WITH A PURGE CONTROL MEANS

BACKGROUND OF THE INVENTION

The present invention relates to an image forming apparatus wherein an electrostatic image, for example, is developed with a developing agent, and more particularly, to an image forming apparatus wherein an occurrence of image defects caused by a discharge phenomenon of foreign matters in the course of developing can be prevented.

For example, in a certain image forming apparatus for developing an electrostatic image with a developing agent, there are provided an image carrier (hereinafter referred to sometimes as a photoreceptor drum), a developing agent carrier that is close to the image carrier and carries a developing agent, and a clearance regulating member that regulates a clearance between the image carrier and the developing agent carrier, there is used a two-component developing agent, for example, as a developing agent, and a developing agent is supplied from the developing agent carrier to the image carrier to superpose toner images each being different in color for developing while the image carrier impressed with AC bias voltage makes plural turns.

Incidentally, there is a tendency that a thin layer of a two-component developing agent, for example, is supplied on the developing agent carrier so that the clearance is narrowed, and AC bias voltage of high electric field is impressed for the purpose of high speed developing for high quality images.

On the other hand, due to the aforesaid tendency, there is a tendency that image defects which are the so-called ring marks tend to occur. The cause for this is considered that when conductive powder (0.1–0.4 mm in size) passes through a narrow clearance (0.4–0.8 mm) for supplying a thin layer of two-component developing agent to a developing agent carrier, ionization is caused between a image carrier and a tip of the powder to destroy latent images and thereby ring-shaped or disk-shaped (spot-like) latent image defects are formed. It has been confirmed further that the image defects tend to occur or they lead to serious defects when a value of AC voltage is high, the clearance is narrow and a particle of powder is large.

In such an image forming apparatus, there is a tendency that foreign matters sometimes enter a developing unit when replacing or transporting a developing unit, and ring marks are caused suddenly. In that case, image forming operation advances normally for a certain period of time during which ring mark problems decrease, and then, suddenly, the problems happen.

SUMMARY OF THE INVENTION

The invention has been attained in view of the above-mentioned points, and its object is to provide an image forming apparatus wherein foreign matters are removed positively from a developing unit and thereby occurrences of image defects of ring marks caused by entrance of foreign matters in the developing unit can be reduced.

Further, its object is to provide an image forming apparatus wherein foreign matters are selectively removed from a developing agent. Still further, its object is that the above-mentioned removal of foreign matters is executed at the timing other than of image formation process so that the image formation is not influenced by the foreign matters. Still further, its object is that the above-mentioned removal of foreign matters is executed at the timing of toner density reference value control for toner density control so that the toner density is not influenced by the foreign matters.

For solving the problems mentioned above, the invention is represented by an image forming apparatus composed of an image carrier, a developing unit that impresses AC voltage on a developing agent carrier that is close to the image carrier and carries a developing agent, a transfer unit that transfers toner images on the image carrier onto a recording materials, and a cleaning unit that removes residual toner on the image carrier, wherein there is provided a special step to eject selectively foreign materials existing in the developing unit from the developing agent carrier to the image carrier.

There is also provided a purge control means that executes the above-mentioned special step with prescribed signals from an exclusive key or an operation section, or from a host control section side.

Further, the special step mentioned above is provided with a first purge control executed concurrently with reference adjustment for toner density control and a second purge control executed based on an operation command of a user or on a periodical action command.

In the invention, there is provided a special step for removing positively from a developing unit the foreign matters which cause ring marks, and thereby the foreign matters are removed positively from the developing unit through operation of the special step and thus occurrences of image defects of ring marks are reduced.

Further, prescribed signals from an exclusive key or an operation section or from a host control section side operate the special step based on a command of a user when foreign matters exist inside so that the foreign matters are positively removed from the developing unit and thereby occurrences of image defects of ring marks are reduced. When there is a high possibility of existence of foreign matters, the special step is operated automatically to removed the foreign matters positively from the developing unit so that occurrences of image defects of ring marks are reduced.

When replacing a developing unit with a new one, the first purge control causing no toner consumption is conducted because a top priority is given to reference adjustment for toner density control, thus, the foreign matters are removed from the developing unit positively and occurrences of image defects of ring marks are reduced.

Further, due to the second purge control executed based on a command of a user operation or on a periodical action command and is excellent in purge performance but causes toner consumption, foreign matters are removed positively from the developing unit and thereby occurrences of image defects of ring marks are greatly reduced immediately.

BRIEF DESCRIPTION OF THE DRAWINGS

FIGS. 10(*a*) 10(*b*) and 10(*c*) are diagrams showing types of a ring mark.

FIG. 11(*a*) is a schematic diagram of the photoreceptor drum unit, and FIG. 11(*b*) is a theoretical diagram showing the potential of a photoreceptor drum.

FIG. 12(*a*) is a schematic diagram showing the photoreceptor drum and developing unit, and FIG. 12(*b*) is a theoretical diagram showing the developing bias voltage.

DETAILED DESCRIPTION OF THE INVENTION

Figure 1:
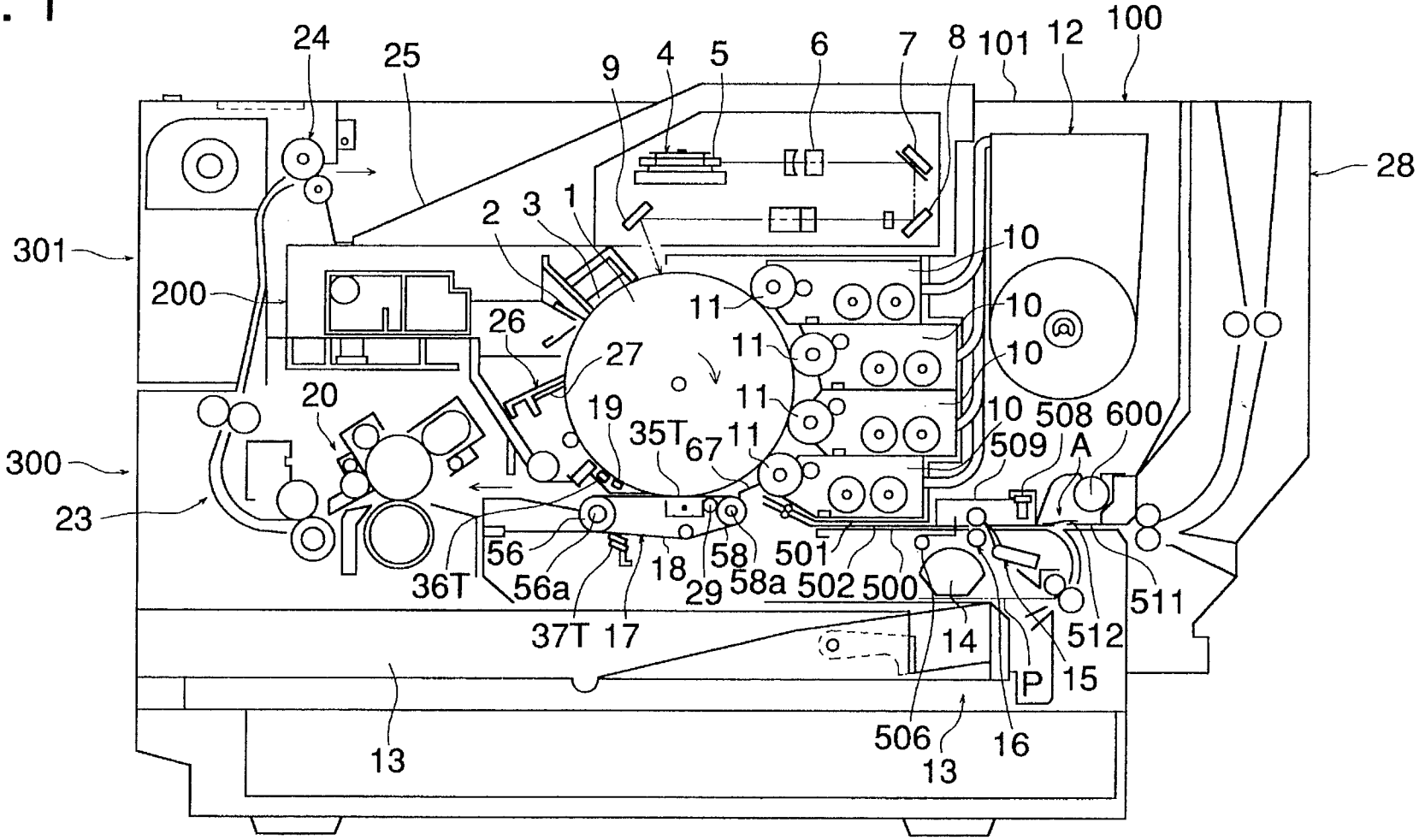
FIG. 1 is a general structural diagram of an image forming apparatus.

Examples of an image forming apparatus of the invention will be explained as follows, referring to the drawings. FIG. 1 is a general structural diagram of an image forming apparatus. As shown in the figure, a photoreceptor drum as image carrier 1 coated on its surface with OPC light-sensitive layer is rotated in one direction (clock-wise direction in the figure) to be neutralized by PCL2 so that charging in the preceding printing is removed and then the circumferential surface of the photoreceptor drum is charged by charging unit 3 uniformly for the succeeding printing. After this uniform charging, imagewise exposure is performed by imagewise exposure means 4 based on image signals. In the imagewise exposure means 4, a laser beam emitted from a laser is subjected to rotary scanning by rotary polygon mirror 5, and then its optical path is deflected by reflection mirrors 7, 8 and 9 after passing through fθ lens 6 to be finally projected on the circumferential surface of the image carrier charged in advance, thus, a latent image is formed on the surface of the image carrier 1.

Around the image carrier 1, there are provided developing units 10 each being filled with developing agent composed of a mixture of each of yellow (Y), magenta (M), cyan (C) and black (K) toners and magnetic carrier. First developing with the first color is conducted by developing agent carrier 11 that houses magnets and rotates while holding developing unit 10. Developing agents are regulated to a predetermined thickness on the developing agent carrier 11 by a layer forming bar and conveyed to a developing area. AC bias voltage and DC bias voltage are superposed to be impressed between the image carrier 1 and the developing agent carrier 11, so that images are visualized through a known method.

After development for the first color has been completed in the aforesaid manner, the sequence advances to the image forming step for the second color (magenta) wherein the image carrier is charged uniformly again, and the same image forming step as for the second color is conducted also for each of the third color (cyan) and the fourth color (black), thus the developing steps for four colors in total are conducted on the image carrier.

On the other hand, a recording material fed by sheet-feed mechanism 14 from sheet-feed cassette 13 is conveyed by transfer unit 17 around which transfer belt 18 is stretched to nip portion 35T formed between the image carrier 1 and the transfer belt 18, thus, a multi-color image on the circumferential surface of the image carrier 1 is transferred onto the recording material collectively. In this case, high voltage is impressed on shaft 58*a* of holding roller 58 positioned at the upstream side for the movement of the transfer belt 18, and conductive brush 67 is provided at the position facing the shaft 58*a* across the transfer belt 18, thereby the recording material can advance to the transfer area while being attracted to the transfer belt 18 by electric charges injected to the recording material through the conductive brush. The recording material separated from the image carrier 1 is separated from the transfer belt 18 while being neutralized by a counter electrode represented by shaft 56*a* of holding roller 56 at the downstream side around which the transfer belt 18 is stretched. Toner sticking to the transfer belt 18 is removed by cleaning blade 37T. Incidentally, when forming multi-color images, the transfer belt 18 is swiveled around the center of the shaft 56*a* of the holding roller 56 at the downstream side so that the transfer belt is separated from the image carrier 1.

The recording material separated from the transfer unit 17 is conveyed to fixing unit 20 composed of two pressure rollers at least one of which is provided therein with a heater. When the recording material is between the two pressure rollers, heat and pressure are applied to the recording material and thereby toner sticking thereto is fused and fixed on the recording material which is then ejected out of the apparatus.

Toner remaining on the image carrier 1 after transferring is neutralized by neutralizing unit 19 and then is conveyed to cleaning unit 26 where it is scraped down into the cleaning unit 26 by cleaning blade 27 that is in contact with the image carrier 1. After that, the toner is ejected out by a screw or the like to be collected in a collecting box. The image carrier 1 from which remaining toner is removed by the cleaning unit 26 is charged uniformly by charging unit 3 after being neutralized by PCL 2, and then it enters the following image forming cycle. When the recording material is wound around the image carrier 1 without being separated from the transfer belt 18 and then enters the cleaning section, there is a risk that the recording material can not be taken out, the cleaning blade and a charging electrode wire may be broken, or the charging unit 3 and PCL 2 may be deteriorated in terms of performance. Accordingly, jam sensor 36T which detects the wound recording material is provided in the vicinity of a neutralizing unit.

In this image forming apparatus, linear speed VL in the case of a normal mode is 74.4 mm/s that is a normal speed. When an OHT sheet is detected by paper type detection sensor 508 under an OHT mode, the speed is normal when forming color toner images on the image carrier 1, and it is switched to a low speed of 12.4 mm/s in the steps of transfer and thereafter.

A latent image is formed in a color image forming apparatus in the following manner.

PCL 2 is arranged at the upstream side of charging unit 3 and it conducts surface exposure for the purpose of eliminating hysteresis on the surface of image carrier 1, namely on the surface of a photoreceptor, before printing so that remaining images on the surface of the image carrier may be erased. As PCL 2, an LED array is used, and it is lit only before forming an image of the first color in the case of a full color occasion while it is lit constantly in the case of a mono-color occasion.

As charging unit 3, a scorotron electrode is used. As a charging wire, there is used a wire with an outside diameter of 60 μϕ whose core material is a tungsten wire and whose surface is coated with gold. Corona current is established to 400 μA (voltage: −4.5—5.5 kv) by a constant-current power supply which is not illustrated. A grid electrode is one manufactured by gold-plating a mesh made of stainless steel on which holes are made through etching treatment.

The grid electrode is arranged between a photoreceptor and a charging wire so that it faces the photoreceptor and is away therefrom by a prescribed distance within a range of 1–2 mm. On the grid electrode, there is usually impressed grid voltage VG of −600 v. Incidentally, charging voltage $V_H$ is highly controlled so that it keeps a predetermined value (−650 v) constantly regardless of detected signals including characteristics of the photoreceptor, charging process for an image of the n-th color, the number of photoreceptor drums used and ambient temperature and humidity.

With regard to writing, imagewise exposure based on image signals is conducted by imagewise exposure means 4 after image carrier 1 is charged uniformly. In the imagewise exposure means 4, an optical path generated from an unillustrated laser diode that is an emitting light source passes through rotating polygon mirror 5, fθ lens 6 and others and then is deflected by reflection mirrors 7, 8 and 9 for scanning, and a latent image is formed when the image carrier 1 rotates.

A quantity of light for laser scanning exposure made on a unit pixel of a photoreceptor is determined as the product of laser output (laser power) and a period of time during which the laser is lit to expose a unit pixel (PW pulse width). With regard to the laser output, the laser is lit forcedly each time a non-image area passes, and voltage for driving the laser is controlled (APC control) so that photoreceptor signals obtained by an unillustrated photo-sensor may keep the prescribed value. The laser output is changeable depending on sensitivity characteristics of a photoreceptor, ambient temperature and humidity, and the number of photoreceptors used.

An electric potential on an exposure section of each part of a latent image can be freely formed through control (PWM) wherein PW for each pixel of a latent image on a photoreceptor is modulated. On the apparatus main body, the laser output is established to operate on a standard level so that full lighting of PW represents the state of 50% (PWM ratio: 0.5) and an electric potential on an exposure section in the case of lighting for each pixel shows −170 v.

Next, shade correction (KNC correction) related to toner image superposing process will be explained as follows. On the present apparatus, PW of the primary color images (yellow, magenta and cyan) section shows PWM ratio=1 under the condition of full lighting. PW of the secondary color images (red, green and blue) section can be switched between the first color image and the second color image both of 2-color superposition. Owing to this, the control is made so that each different color toner of the secondary color images may be formed similarly on the final recording material, by adjusting exposure electric potential for the first color image and that for the second color image to the desired values respectively. As a standard, PW of the second color image is made to be the same as the primary color image section, while PW of the first color image is made to be 50% lighting (PWM ratio: 0.5). Further, depending on the taste of a user, the shade of the secondary color image can also be changed freely to a certain extent from the standard by changing the PWM ratio of the primary color image.

In the case of ERT correction (processing) which equalizes the shade among isolated dots, characters, fine lines, dummy intermediate image sections, and solid sections, there are detected the edge pixel signals from image signals for which a laser is lit, while for an edge image, when it corresponds to the first color image of the secondary color images, PWM control is made so that the PWM ratio is made to be close to 1 and to PW of the second color image of the secondary color images.

Around the image carrier 1, there are provided developing units 10 each being filled with developing agent composed of a mixture of each of yellow (Y), magenta (M), cyan (C) and black (K) toners and magnetic carrier. First developing with the first color is conducted by developing agent carrier 11 that houses magnets and rotates while holding developing agents. To each developing unit 10, developing agent is supplied from toner cartridge 12. Both developing units 10 and toner cartridge 12 are affixed to developing device 100 and they can be replaced together with the developing device 100. When toner supply door 101 is opened, toner can be supplied. For inspection of the developing device 100, an unillustrated developing door is opened and the developing device 100 is taken out for the inspection.

A developing agent is composed of a magnetic carrier whose core is ferrite that is coated with insulating resin and toner whose primary material is polyester to which dyes depending on a color, charge controlling agent, silica and titanium oxide are added. The developing agent is regulated to be in a layer thickness (developing agent) of 100–600 μm on developing agent carrier 11, and is conveyed to a developing area.

A clearance between the developing agent carrier 11 and the image carrier 1 in the developing area is made to be 0.4–0.6 mm greater than the layer thickness (developing agent), and AC bias of $V_{AC}$ and DC bias of $V_{DC}$ are superposed to be impressed on the clearance, and there is provided a bias-donating means that impresses AC voltage on the developing agent carrier 11 so that the maximum electric field of 2.5 MV/m or more may be formed in the clearance. Since $V_{DC}$, $V_H$ and toner charging are the same in terms of polarity, toner urged by $V_{AC}$ to leave the magnetic carrier does not stick to the section of $V_H$ that is higher than $V_{DC}$ in terms of electric potential but sticks to the section of $V_L$ that is lower than $V_{DC}$, thus, visualization (reversal development) is conducted. After completion of the visualization for the first color, sequence advances to the step of image forming for the second color, and uniform charging is conducted by charging unit 3 again, and a latent image based on image data of the second color is formed by imagewise exposure means 4. In this case, neutralizing which was made by PCL 2 in the image forming step for the first color is not conducted because toner sticking to the image section for the first color may scatter due to rapid fall of ambient electric potential.

On the photoreceptor wherein the entire circumferential surface of image carrier 1 has been charged to electric potential of $V_H$ again, the area having no image of the first color is subjected to formation of a latent image identical to that for the first color and the latent image is developed, while the area having the image for the first color and being developed again is subjected to formation of a latent image of $V_M$ by light shielding with toner for the first color and by charges owned by toner itself, and the latent image is developed corresponding to the voltage difference between $V_{DC}$ and $V_M$. On this section where the image for the first color is superposed with that for the second color, when development for the first color is conducted after forming a latent image of $V_L$, a balance between the first color and the second color is lost. Therefore, intermediate potential satisfying the relation of $V_H>V_M>V_L$ is sometimes used by reducing quantity of exposure for the first color. In this manner, toner images of 4 colors of Y, M, C and K each being different each other in terms of color are formed on the photoreceptor drum in succession, and pixels on the circumferential surface of the image carrier 1 are visualized in 7 colors of Y, M, C, R(Y+M), G(Y+C), B(M+C) and K.

On the other hand, recording material P conveyed from sheet-feed cassette 13 through sheet-feed mechanism 14 is stopped at sheet-feed guide section 15 temporarily, and then is conveyed to a transfer area through rotation of sheet-feed roller 16 after matching of transfer timing. In the transfer area, there is arranged transfer unit 17, and transfer belt 18 is pushed to image carrier 1 by transfer roller 29 of the transfer unit 17 to sandwich the recording material P that is fed to the circumferential surface of the image carrier in synchronization with transfer timing, thus multi-color images are transferred collectively.

Then, after transferring, the recording material P leaves the image carrier 1 together with the transfer belt 18, and is transported. Neutralizing unit 19 is provided with openings on its side facing the image carrier 1 and on its rear side. and positive corona ions and negative corona ions are emitted alternately from these openings, thus, the surface of the image carrier 1 is neutralized and the recording material P on the transfer belt 18 as well is neutralized simultaneously. The recording material P is separated from the transfer belt 18 while being neutralized by the neutralizing unit 19, and then is conveyed to fixing unit 20 where the recording material is heated and pressurized by heat roller 21 and pressure roller 22 so that toner is fused and fixed on the recording material. After that, the recording material is conveyed by sheet exit unit 23 to be ejected to copy tray 25 located outside the apparatus through exit roller 24.

Incidentally, the transfer belt 18 leaves the circumferential surface of the image carrier 1 after the recording material P has passed to be ready for the succeeding formation of toner images. On the other hand, the image carrier 1 from which the recording material P has been separated is subjected to pressure contact with cleaning blade 27 of cleaning unit 26 and thereby remaining toner on the image carrier is removed and cleaned, and then the image carrier is neutralized by PCL 2 again and charged by charging unit 3 to enter the following image forming process. Incidentally, the cleaning blade 27 moves to leave the circumferential surface of the image carrier 1 immediately after cleaning the photoreceptor surface of the image carrier 1.

The image carrier 1, PCL 2, the charging unit 3 and the cleaning unit 26 are all attached to drum unit 200 so that they can be replaced together with the drum unit 200.

On the rear side of the color image forming apparatus, there is provided manual sheet insertion unit 28 which conveys recording material P, OHT sheet, for example, inserted manually to sheet-feed unit 15.

This color image forming apparatus is of a clamshell type that opens and closes, and upper shell 301 can swivel against lower shell 300 around hinge 600 provided at the manual sheet insertion unit 28 on the lower shell 300 that serves as a fulcrum. The lower shell 300 is provided with sheet-feed cassette 13, sheet-feed unit 15, transfer unit 17 and fixing unit 20, while, the upper shell 301 is provided with imagewise exposure means 4, developing device 100 and drum unit 200. With regard to the developing device 100 and the drum unit 200 both are a process unit, when the upper shell 301 is opened, the developing device 100 can be mounted or dismounted in the direction of a drum axis through a slide guide made of metal, while the drum unit 200 can be mounted or dismounted from the sheet exit side (front side) through a metal guide on which both panels of the upper shell 301 are provided, so that they are replaced with new ones after being used for the prescribed number of prints.

Accordingly, when the upper shell 301 is opened against the lower shell 300 through swiveling around a fulcrum located on the side of the manual sheet insertion unit 28, the developing device 100 and the drum unit 200 both on the upper shell 301 are positioned above sheet-feed guide section 15.

Figure 2:
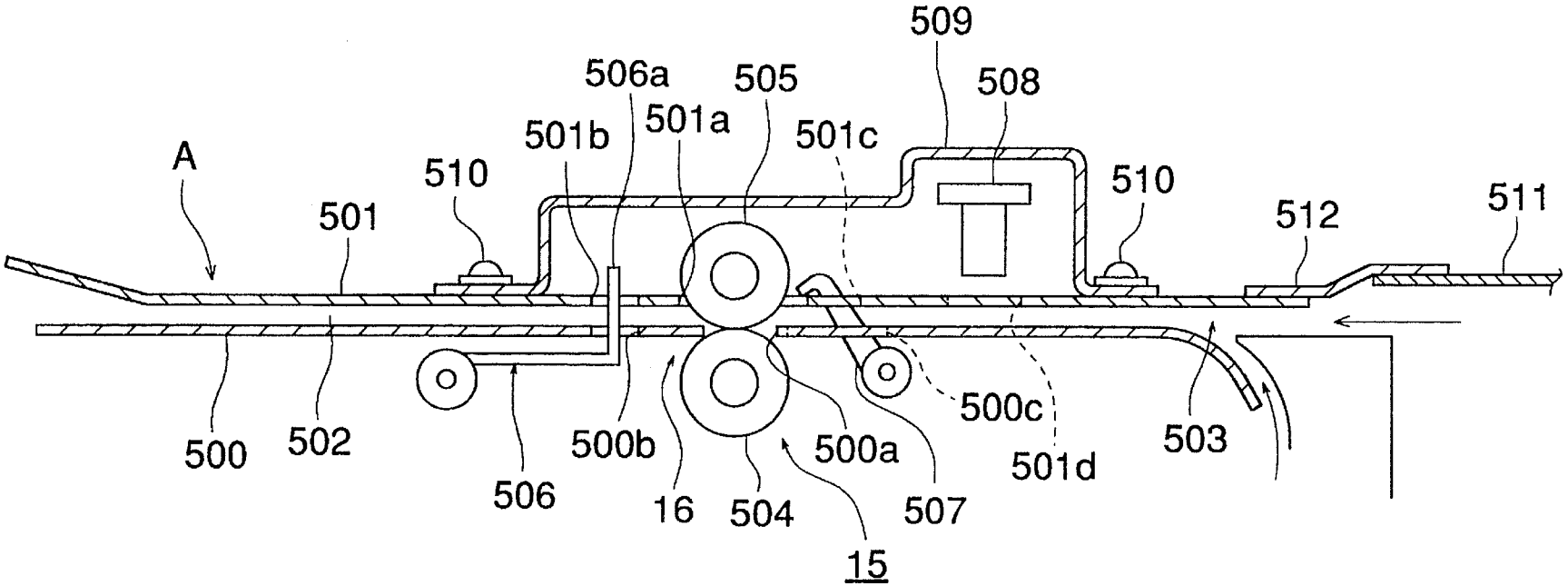
FIG. 2 is a sectional view of a sheet-feed guide section.
Figure 3:
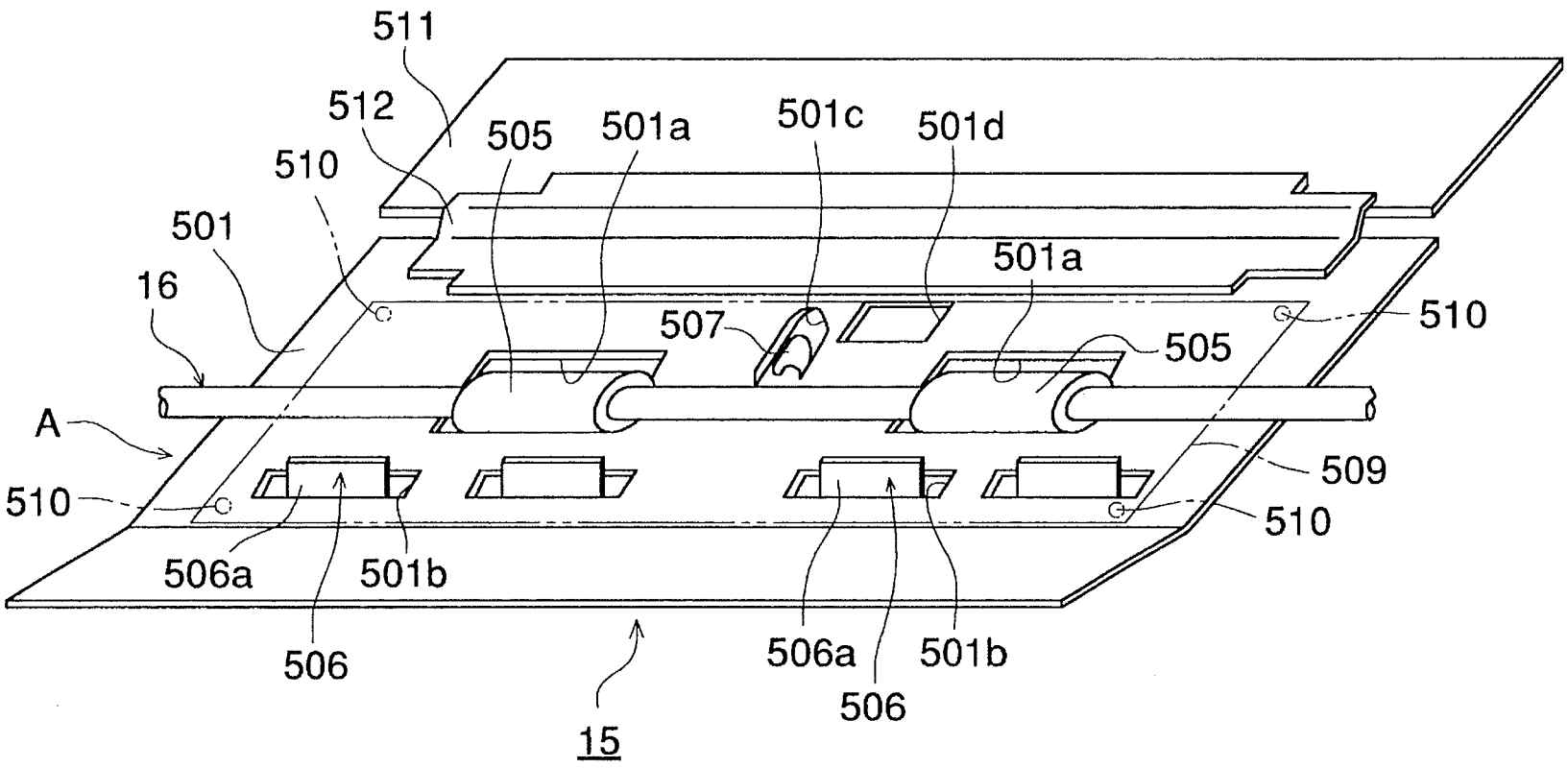
FIG. 3 is a perspective view of a sheet-feed guide section.

The sheet-feed guide section 15 is structured as shown in FIGS. 2 and 3. FIG. 2 is a sectional view of the sheet-feed guide section, and FIG. 3 is a perspective view of the sheet-feed guide section.

On the sheet-feed guide section 15, sheet-feed path 502 is formed by lower sheet-feed guide 500 and upper sheet-feed guide 501 both arranged to face each other. At the upstream side of the sheet-feed path, there is provided junction 503 where recording material P, an ordinary sheet, for example, fed from sheet-feed cassette 13 and recording material P, an OHT sheet, for example, fed from the manual sheet insertion unit 28 join. The upper sheet-feed guide 501 covers an area from the upstream side of transfer unit 17 to the portion near hinge 600 affixed on the lower shell 300.

On the sheet-feed path 502, there is arranged sheet-feed roller 16 which is composed of lower roller 504 and upper roller 505. The lower roller 504 is protruded into the sheet-feed path 502 through window portion **500*a* formed on the lower sheet-feed guide 500, while, the upper roller 505 is protruded into the sheet-feed path 502 through window portion 501*a* formed on the lower sheet-feed guide 501, thus the recording material P is sandwiched between the lower roller 504 and the upper roller 505** to be conveyed.

On the downstream side of sheet-feed roller 16, there is provided registration shutter 506 that controls timing so that a sheet is conveyed when the transfer timing is matched. Shutter portion **506*a* of the registration shutter 506 is positioned to pass through window portion 500*b* formed on the lower sheet-feed guide 500, sheet-feed path 502 and window portion 501***b* formed on the upper sheet-feed guide 501. At this position of the shutter portion 506*a*, the recording material P is stopped, and when the recording material P is conveyed, the shutter portion 506*a* is swiveled downward to come off 500*b* of the lower sheet-feed guide 500 and 501*b* of the upper sheet-feed guide 501 so that the sheet-feed path 502 may be opened.

At the upstream side for the sheet-feed roller 16, recording material detection actuator 507 passes the sheet-feed path 502 fro window portion 500*c* formed by the lower sheet-feed guide 500 and passes through window portion 501*c* formed by the upper sheet-feed guide 501 to be positioned. When recording material P is fed, this recording material detection actuator 507 is pushed downward to rotate by the recording material P, and thereby the feeding of the recording material P is detected. At the upstream side for the recording material detection actuator 507, there is arranged, above the upper sheet-feed guide 501, paper type detection sensor 508 that detects the type of paper. The paper type detection sensor 508 is positioned to face window portion 501*d* formed by the upper sheet-feed guide 501, and it detects sheet-feeding of OHT sheet from this window portion 501*d*.

On the upper sheet-feed guide 501, there is provided cover 509 that is affixed by machine screws 510. The cover 509 is of a type of a dome that covers window portions 501*a*, 501*b*, formed by the upper sheet-feed guide 501, 501*c* and 501*d*, shutter portion 506*a* of registration shutter 506 positioned at those window portions, upper roller 505 of sheet-feed roller 16, recording material detection actuator 507 and paper type detection sensor 508. In addition, there is provided shielding member 512 capable of being deformed elastically between the upper sheet-feed guide 501 and fixed guide 511 on hinge 600 provided on the lower shell 300, and the shielding member 512 is deformed to shield when the lower shell 300 is opened and closed.

As stated above, the upper sheet-feed guide 501, cover 509 and shielding member 512 form together foreign matter falling prevention member A which is provided above sheet-feed guide portion 15 and is of shielding structure in at least a width of paper transport and prevents foreign matters from falling in the sheet-feed guide portion 15. The foreign matter falling prevention member A is positioned above the lower sheet-feed guide 500 and shields an entire area from fixed guide 511 on the hinge 600 side to the upstream side for transferring. Further, the upper sheet-feed guide 501 provided on an entire area of the upstream side for transferring is provided with cover 509 to be of a shielding structure which assures that foreign matters do not fall on sheet-feed path 502 at least in the paper transport area.

Due to the foreign matter falling prevention member A that is provided above the sheet-feed guide portion 15 to be equipped with a shielding structure at the paper transport width, even if metallic foreign matters sticking to the upper shell 301, developing unit 100 and drum unit 200 are moved by shock or inclination and are dropped when a clamshell is opened or closed, the foreign matter falling prevention member A can prevent the foreign matters from falling in the sheet-feed guide portion 15.

Further, due to the two-piece structure of clamshell opening/closing wherein upper shell 301 can be opened or closed for lower shell 300, in particular, when the upper shell 301 is opened from the lower shell 300 with a hinge on the by-pass feed unit 28 side, developing unit 100 and drum unit 200 both in the upper shell 301 are positioned above the sheet-feed guide portion 15 of the lower shell 300. Under the condition that the upper shell 301 is opened, the developing unit 100 is detachable through a metal slide guide in the axial direction of a drum and the drum unit 200 is detachable through a metal guide provided on both panels of the upper shell 301 from the paper exit side. Thus, even if foreign matters sticking to process units or to doors fall when replacing with new one after using for predetermined number of prints, the foreign matter falling prevention member A prevents the foreign matters from entering the sheet-feed guide portion 15.

Therefore, foreign matters can not enter sheet-feed path 502 of the sheet-feed guide portion 15. Thus, it does not happen that foreign matters are carried by recording material P over to transfer unit 17 as in the past. Accordingly, when transferring is carried out at the transfer unit 17, it is prevented that foreign matters move to image carrier 1, and thereby it is reduced that foreign matters arrive at developing unit 10 or developing clearance Dsd through the image carrier 1 serving as a medium to cause ring marks.

Figure 4:
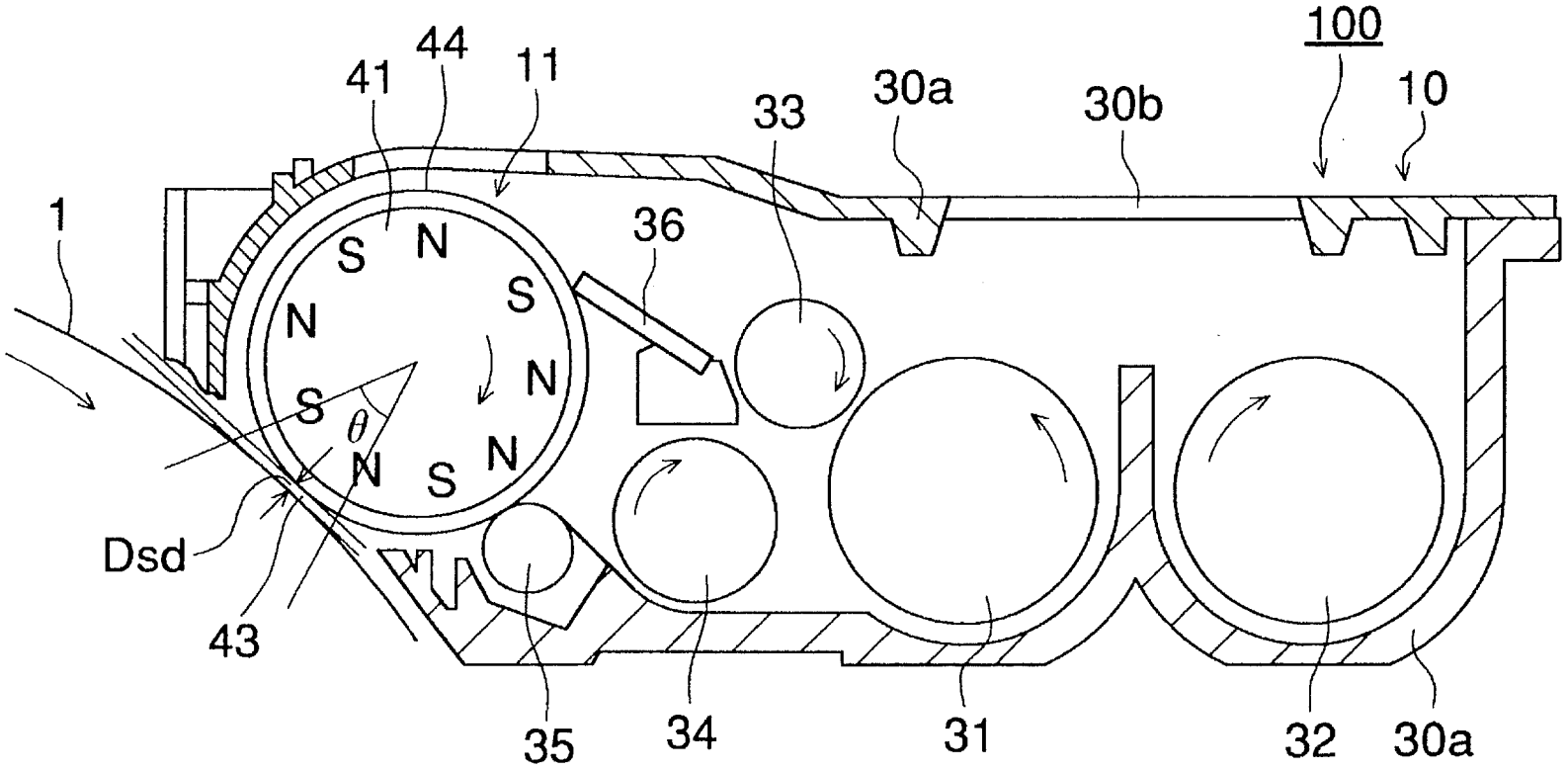
FIG. 4 is a sectional view of a developing unit.
Figure 5:
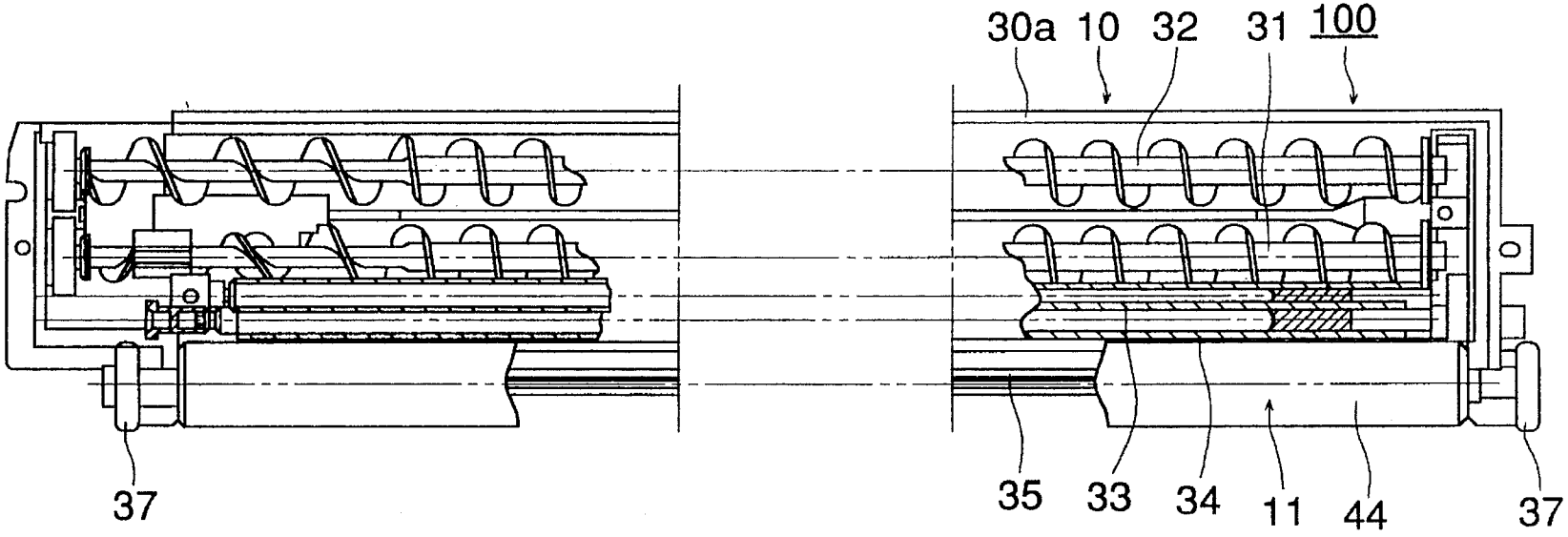
FIG. 5 is a top view of a broken part of the developing unit.
Figure 6:
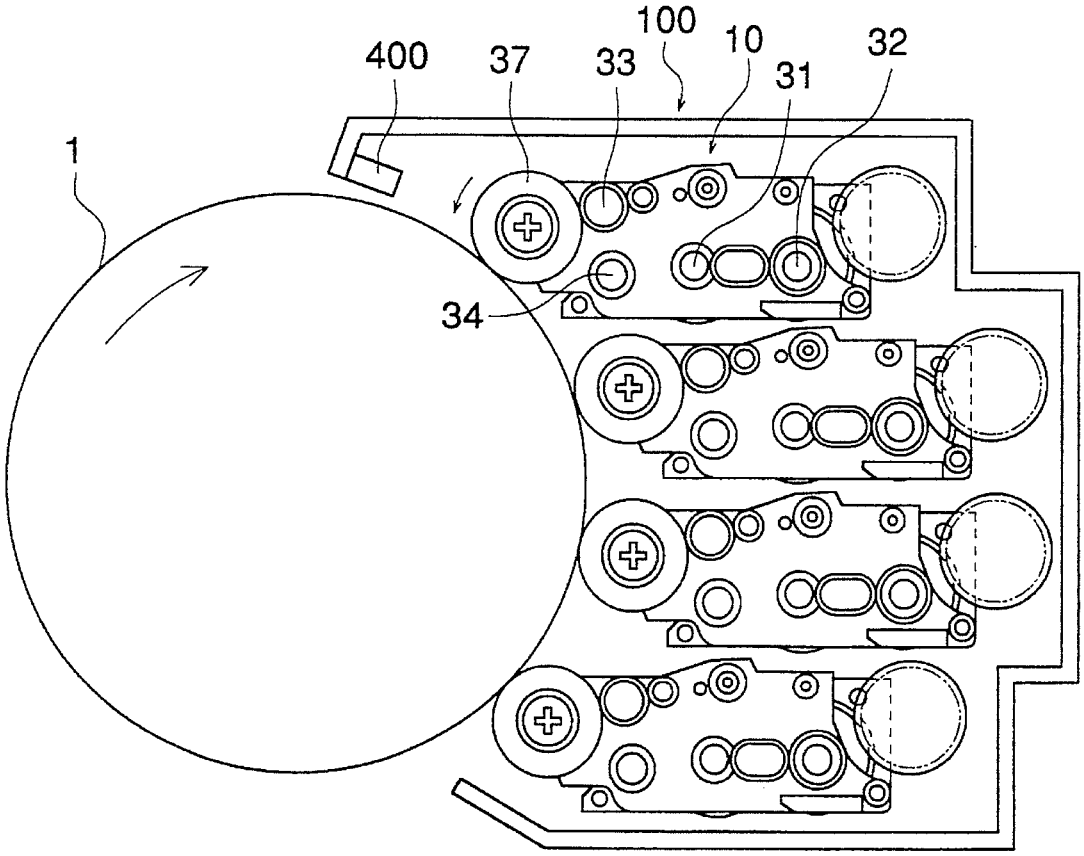
FIG. 6 is a side view of the developing unit.

Next, how a developing unit is structured will be explained as follows, referring to FIGS. 4–6. FIG. 4 is a sectional view of the developing unit, FIG. 5 is a top view showing the partially broken developing unit, and FIG. 6 is a side view of the developing unit.

Developing unit 10 provided on developing device 100 is arranged to face the image carrier 1, and casing 30*a* of the developing unit 10 is covered with cover 30*b* and inside thereof, there are provided developer carrier 11, a pair of stirring screws 31 and 32, stirring roller 33, supply roller 34, thin layer forming bar 35 and scraper 36. The developer carrier 11, a pair of stirring screws 31 and 32, stirring roller 33 and shaft portions at both ends of supply roller 34, are pivoted on the side wall of the casing 30*a*. On the both ends of the developer carrier 11, clearance regulating members 37 are attached rotatably. The clearance regulating members 37 are in contact with two portions on an aluminum drum where OPC photoreceptor is not coated at both ends, and the clearance regulating members 37 regulate clearance Dsd which is a developing clearance between image carrier 1 and developer carrier 11.

The developer carrier 11 is provided with cylindrical sleeve 44 that rotates in the arrowed direction, and inside the sleeve 44, there is affixed magnetic field generating means 41 which is composed of a magnetic body having plural magnetic poles.

Toner supplied from toner cartridge 12 is dropped from supply port 30*b*1 of cover 30*b* of the developing unit 10 on a pair of stirring screws 31 and 32 arranged on the casing 30*a*,, and then is mixed with magnetic carrier by a pair of stirring screws 31 and 32 which rotate in the opposite direction each other and by stirring roller 33, so that the toner is set to a predetermined charge amount (Q/M) while toner density is detected through L detection method. Based on the output frequency resulted from the detection, an amount of toner supply is controlled, for example, it is subjected to program variable control to be set to toner density value of about 7–11%. Two-component developer thus stirred is conveyed to developer carrier 11 through supply roller 34. Then, it is made to be a thin layer by thin layer forming bar 35 and is conveyed to a developing area that faces image carrier 1 to conduct reversal development on electrostatic latent images under the developing condition stated below. At the downstream side of the developing area, scraper 36 is arranged under the supply roller 34 for scraping from the developer carrier 11 the developer wherein toner is dried at the developing area and for returning the developer to the stirring screws 31 and 32.

Example of Toner Composition

| | |
|---|---|
| Styrene-butylmethacrylate (75:25) copolymer resin | 100 parts by weight |
| Coloring agent | 10 parts by weight |
| Varifast (made by Orient Chemical Co.) | 0.2 parts by weight |
| Polypropylene with softening point of 120° C. | 2 parts by weight |

Above ingredients are subjected to melting, kneading, cooling, crushing and tangling to be yellow (Y), magenta (M) and cyan (C) toners with average particle size by weight of 15μ and to be black (K) toner with average particle size by weight of 11μ, and those with particle size of 5–20 μm are preferably used.

As resins used for toner, there are given styrene type resin, vinyl type resin, ethyl type resin, rosin-denatured resin, acryl type resin, polyamide resin, epoxy resin, and polyester resin, to which. coloring agent such as carbon is added and, when necessary, fixing property improving agent and charging control agent are also added. It is possible to manufacture toner through a method similar to the conventional and known toner particle making method. When toner particles are made to be spherical after the particles are provided by a spray dry method or by a granulation, fluidity of developer is improved to inhibit condensation, and a property to be mixed uniformly with magnetic carrier, a property to be transported and a property to be charge electrically are improved.

As a coloring agent for toner, dyes and pigments are generally used, and weatherproofing pigments are widely used. As a pigment, carbon black (black), Benzidine yellow (yellow), Rhodamine B (magenta), and copper Phthalocyanine (cyan) are used. These organic or inorganic pigments are used independently or used in combination selectively as needed so that the desired image color may be obtained. As an added amount of pigments, the number of parts of pigments ranging from 3 parts to 15 parts for resin is preferably selected.

With regard to magnetic carrier, insulating carrier is used and an average charge amount Q/M is 15–25 μC/gr (20–40 emu/gr). As a shell, those made of styrene resin and having a layer thickness of 0.5 μm are used.

When an average particle size of magnetic carrier is large, a developer layer formed on developer carrier 11 is poor in terms of state, unevenness tends to appear on toner images even when vibration is given to them by oscillating electric field, and thereby toner density in a developer layer is lowered, making the development with high density to be difficult. When an average particle size of magnetic carrier is small, carrier particles which are too small tend to stick to the surface of a photoreceptor together with toner particles and to scatter. These phenomena relate to the intensity of the magnetic field to be applied to the magnetic carrier as a developing condition and to the intensity of magnetization of the carrier particles exposed to the magnetic field, and magnetic carrier wherein average particle size by weight is 30–120 μm, and magnetic susceptibility under the magnetic field of 500 oersted is 20–50 emu/g is preferably used.

As a developer, those made in a way to mix so that toner may show 9 wt % against the aforementioned magnetic carrier and to add 0.5 wt % of hydrophobic silica as an additive are widely used.

Two-component in casing 30*a* is stirred by stirring screws 31 and 32 and stirring roller 33 and thereby is charged electrically so that toner sticks electrostatically to the outer surface of a magnetic carrier particle. The developer in such a state is moved by rotating supply roller 34, and then is stuck to developer carrier 11 by magnetic force of a magnetic body in magnetic field generating means 41. The developer stuck to the developer carrier 11 is conveyed to a developing area where image carrier 1 is in closest contact with the developer carrier 11, after being layer-thickness-regulated to a predetermined value in a range of 5–10 mg/cm$^2$ per unit area by thin layer forming bar 35. In this developing area, the developer moves without touching the image carrier 1.

The developer carrier 11 rotates at its peripheral speed of 10–50 cm/sec to supply fresh developer to the developing area. An added amount in this case relates to the moving speed of the image carrier 1, and when the amount is insufficient, nothing but under development is conducted. When the number of rotations of the developer carrier 11 is too high, toner tends to scatter.

For conductive sleeve 44 made of metal tube in the developer carrier 11, an aluminum material and stainless steel are used, and the material is a roller having an outer diameter of 15–50 mm ϕ. It is preferable that the surface of the developer carrier 11 has an average surface roughness Rz of 2–5 μm so that developer can be conveyed uniformly and stably. When the surface is smooth, conveyance of developer is not sufficient, and when it is rough, uneven development is caused. For obtaining the aforesaid surface roughness, sandblast treatment is preferably used. In the case of an aluminum material, anodizing process is preferable on the points of sleeve durability and prevention of toner fusing on the sleeve surface. In the present example, sleeve 44 is made of SUS305AC and surface roughness $R_Z$ of the sleeve 44 is 4 μm.

With regard to developer carrier 11, there is provided magnetic field generating means 41 in sleeve 44, and this magnetic field generating means 44 is a magnetic body of 5–9 magnetic poles. It is preferable that angle θ made by adjoining fixed-two magnetic poles in developing area 43 is 25°–80° and the developing area 43 is positioned almost at the center of the angle θ made by the two magnetic poles. It is also preferable that magnetic flux density made by magnetic poles on the surface of the developer carrier 11 is not less than 400 gauss.

It is further preferable on the points of prevention of color mixing in superposing process, prevention of carrier sticking and reproducibility of fine lines that a horizontal magnetic field is formed in the developing area 43. In the present example, magnets are fixed in sleeve 44, the number of magnetic poles is 9, magnetic flux density is 550 gauss and magnetic angle is a horizontal magnetic field.

In the present example, an amount of toner supply is represented by a developer conveyance amount which is established to 8.5 mg/cm$^2$, and a layer thickness regulating system is one wherein a magnetic SUS bar is brought into contact with sleeve 44 by attractive force of magnetic poles generated by magnetic field generating means 41 in the sleeve 44 of the developer carrier 11. Toner density is 9 wt % and its control is made by a control table wherein a control value is changed by the count of developer usage, and the control table is further switched by signals from a humidity sensor. Owing to this, image characteristics can be highly controlled within a desired range, despite changes of developer and of environmental conditions. Development clearance Dsd is 570 μm, and for sleeve 44 of the developer carrier 11, sleeve linear speed is 222 mm/s (linear speed ratio of a photoreceptor drum to the sleeve: 3.0), sleeve diameter is 18.00ϕ and the number of rotations of the sleeve is 244 r.p.m. With regard to developing voltage, DC voltage is −500 V, AC voltage Vp-p is 2.7–2.8 kHz, a waveform is rectangular, alternate frequency fac is 8 kHz.

In the control of developing operation, when passing the non-image area, all developing units 10 are in non-operation state B wherein developer carrier 11 does not rotate, and when passing the image area, only developing units 10 for non-development color are in the non-operation state A wherein developer carrier 11 does not rotate and developing unit 10 for development color is in the operation state.

Magnetic field generating means 400 is attached on developing device 100 which is a replaceable process unit, and that means attracts and holds conductive and magnetic foreign matters which stick to image carrier 1 to cause ring marks, so that the foreign matters are prevented from entering developing unit 10. When the developing device 100 is replaced on condition that upper shell 301 is opened, foreign matters sticking are automatically ejected. For example, the developing device 100 is replaced with new one after being used for 30,000 prints.

Figure 7:
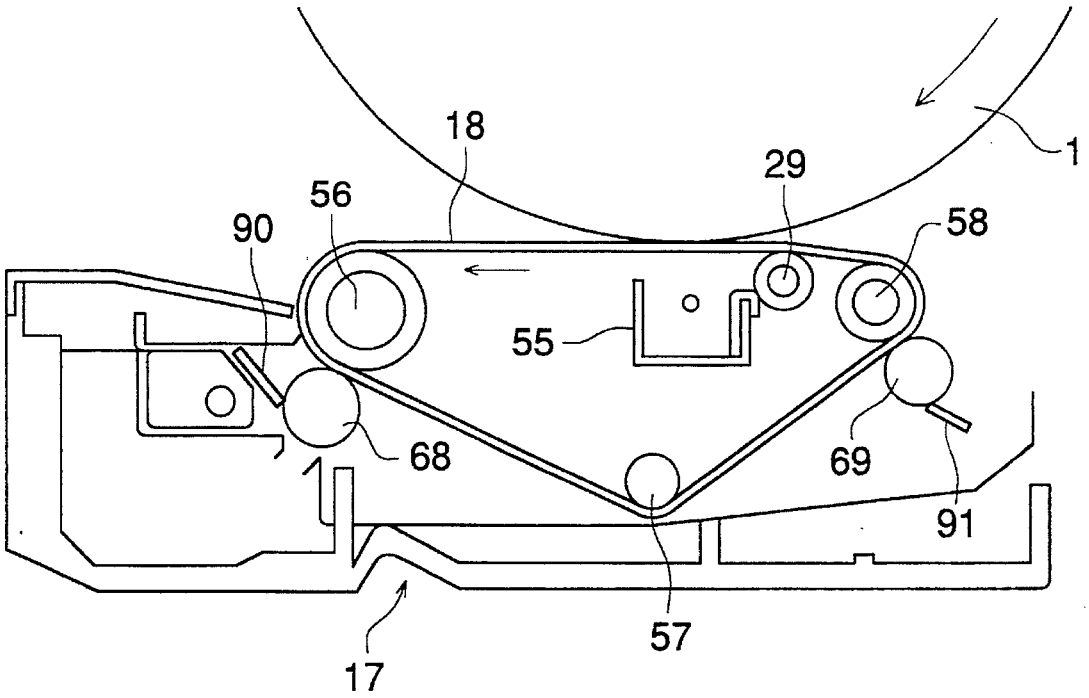
FIG. 7 is a schematic structural diagram of a transfer unit.
Figure 8:
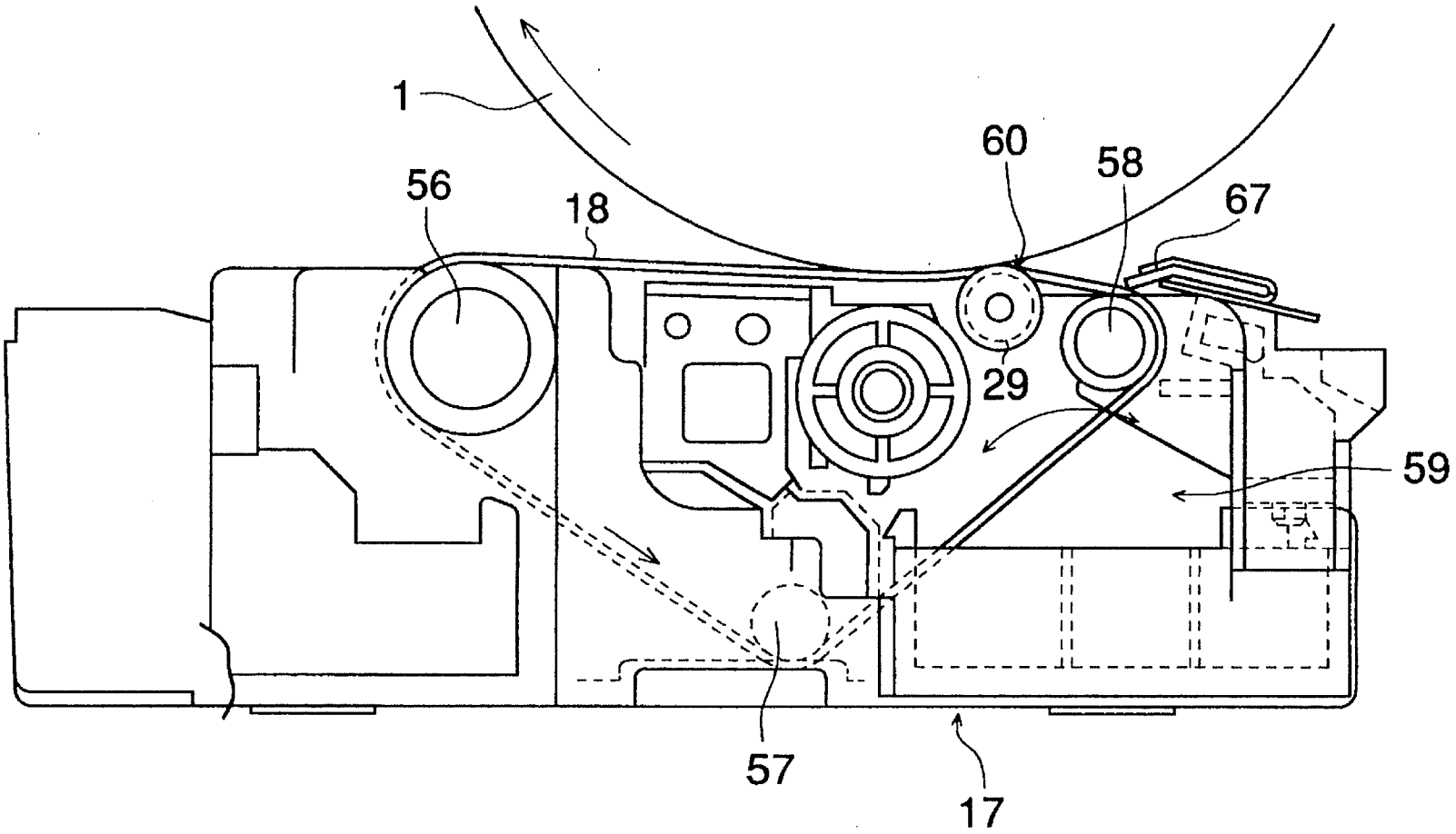
FIG. 8 is a side view of the transfer unit.

Next, how a transfer unit is structured will be explained as follows, referring FIGS. 7 and 8. FIG. 7 is a schematic structural diagram, and FIG. 8 is a side view of the transfer unit.

Transfer unit 17 is of a belt transfer type in which transfer electrode 55 is arranged so that it may face image carrier 1. For the transfer electrode 55, a corona electrode with a plus polarity is used, and it is of a constant current type in which a current value can be changed depending on the following modes or signals from a humidity sensor. With regard to a current value for each mode under normal temperature and normal humidity, the value is 350 μA for FULL mode, 150 μA for MONO mode and 350 μA for OHT mode.

Transfer belt 18 spread over supporting rollers 56 and 58, guide roller 57 and transfer roller 29. With regard to the transfer belt 18, semiconductive urethane rubber is used as a material, a cirumferential length is ϕ56 mm, a thickness is 0.6 mm, and fluorine coating (20 μm) is provided as surface treatment.

The transfer belt 18 is spread through an operation of pressure contact releasing means 59 in synchronization with transfer timing, and thus, recording material P fed to the circumferential surface of image carrier 1 is sandwiched and multi-color images are transferred onto the recording material P collectively. The pressure contact releasing means 59 composed of a cam and a cam follower makes the supporting roller 58 to rotate in the arrowed direction and thereby to separate a supporting portion for the transfer belt 18 from a photoreceptor drum of the image carrier 1. With regard to timing of pressure contact for the transfer belt 18, the belt is in pressure contact during sheet conveyance under a multi-color mode and it is in pressure contact constantly under a mono-color mode.

In transfer unit 17, sheet-front charging is conducted as an auxiliary means of transfer for securing separation of recording material P after transferring. For the sheet-front charging, conductive brush 67 is grounded through Zener element of 900 V, an electrode opposing thereto is provided on supporting roller 58 on which bias voltage 2.0 kv is impressed, and an appropriate amount of negative charges are injected to the recording material P. In addition, a belt cleaner is provided as an auxiliary means for transfer. This belt cleaner is provided with electrostatic recovery roller 68 and supporting roller 56 which are close each other, and bias voltage of 2 kv is applied on the electrostatic recovery roller 68. Electrostatic recovery roller 69 is grounded to be close to the supporting roller 58 on which 2 kv voltage is applied. The electrostatic recovery rollers 68 and 69 are provided respectively with scrapers 90 and 91 on a contact basis, and toner and paper dust are removed by the scrapers 90 and 91. Each of the scrapers 90 and 91 is a PET sheet which is formed with a 0.125 mm-thick member. Further, pre-transfer treatment is conducted as an auxiliary means for transfer. Due to a technology disclosed in Japanese Patent Application No. 71317/1992 and called pre-transfer imagewise exposure wherein 4 images each having a different color of Y, M, C and K are formed (4 rotations of a photoreceptor drum), and then the photoreceptor drum further makes one turn without being charged to superimpose imagewise exposure on the area where Y, M and C toner images exist, it is possible to transfer superposed toner images collectively and stably even when recording material P and environmental conditions change variously.

On both ends of grounded transfer roller 29, there are affixed stopper rolls which serve as clearance regulating member 60. Each of the clearance regulating members 60 is in contact with a portion on aluminum drum where OPC photoreceptor is not coated at both sides of image carrier 1, and the clearance regulating members 60 regulate the clearance between the image carrier 1 and transfer belt 18 to the desired value within a range of 0–0.3 mm.

Figure 9:
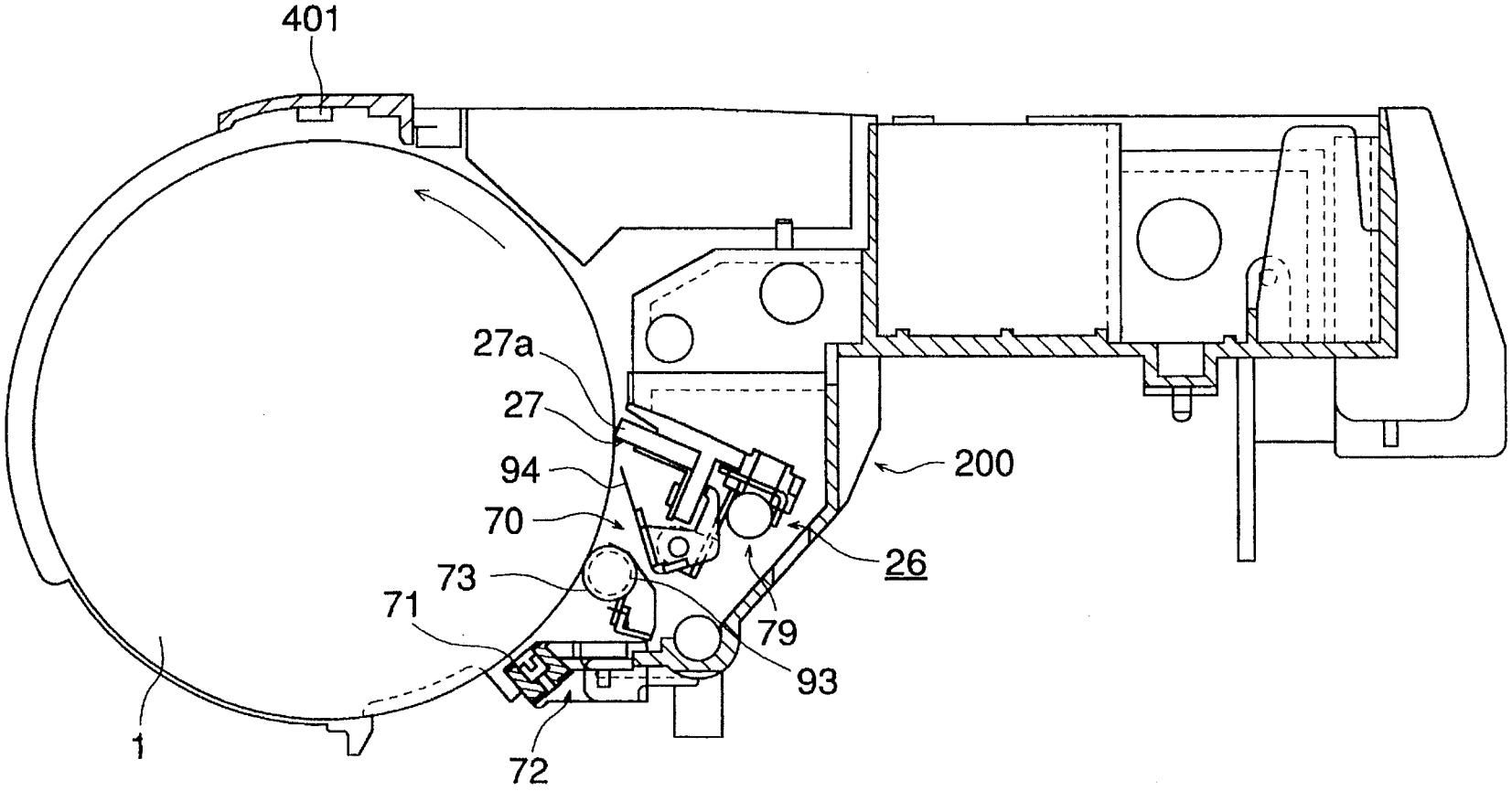
FIG. 9 is a sectional view of a drum unit.

Next, how a cleaning unit is structured will be explained as follows, referring to FIG. 9. FIG. 9 is a sectional view of a drum unit. Drum unit 200 is provided with cleaning unit 26 and image carrier 1, and the cleaning unit 26 removes residual toner for cleaning through pressure-contact of cleaning blade 27 of the cleaning unit 26, and the residual toner thrus dropped is received by toner receiver 70.

The cleaning blade 27 is made of urethane rubber and its tip portion 27*a* is in contact with image carrier 1 on trail system basis. Line load is set to 66 g f/cm. When forming a full color image, the cleaning blade 27 is released from pressure contact. This releasing of pressure contact is carried out through the mechanism of a cam and a cam follower to separate the cleaning blade 27 from a photoreceptor drum of image carrier 1. With regard to timing of this pressure contact releasing, the pressure contact is started at a non-image area within a period of 5 rotations to 6 rotations under a FULL mode, and the pressure contact is released after one rotation of the photoreceptor drum. Cleaning capability immediately after pressure contact is stable and that after sufficient cleaning for one rotation or more is stable, but it is appropriately determined in balance with a print speed. In a MONO mode, the contact is constantly kept.

The cleaning unit 26 is provided with toner receiver 70 and leveling mechanism 72 as an auxiliary means. The toner receiver 70 is composed of electrostatically sealed roller 93 and receiving PET 94, and the electrostatically sealed roller 93 is affixed, while the receiving PET 94 is movable, and they are separated collectively from a photoreceptor drum through linkage with pressure contact releasing for the blade.

Leveling sheet 71 of the leveling mechanism 72 is made of urethane rubber, and the leveling sheet 71 levels the projection (mountain-shaped) of toner remaining after blade releasing down to a thin layer on a photoreceptor drum. Owing to this, when passing developing unit 10, remaining toner is prevented from moving onto developer carrier 11 and entering therein. Further, owing to magnetism generating means 400 wherein magnetic foreign matters exist at the downstream side thereof, efficient adsorption is accelerated.

With regard to operation timing of the leveling sheet 71, the leveling sheet 71 is brought into contact with a photoreceptor drum immediately before passage of toner remaining after blade releasing, and it is separated from a photoreceptor drum immediately after it levels the remaining toner to a width of about 20 cm.

On both sides of the electrostatically sealed roller 93, there are affixed stopper rolls which serve as clearance regulating member 73. Each of the clearance regulating members 73 is in contact with a portion on aluminum drum where OPC photoreceptor is not coated at both sides of image carrier 1, and the clearance regulating members 73 regulate the clearance between the image carrier 1 and the electrostatically sealed roller 93 to the desired value within a range of 0.4–0.5.

Magnetic field generating means 401 is attached on drum unit 200 which is a replaceable process unit, and that means attracts and holds conductive and magnetic foreign matters which stick to image carrier 1 to cause ring marks, so that the foreign matters are prevented from entering developing unit 10. When the drum unit 200 is replaced on condition that upper shell 301 is opened, foreign matters sticking are automatically ejected. For example, the drum unit 200 is replaced with new one after being used for 40,000 prints.

Figure 13:
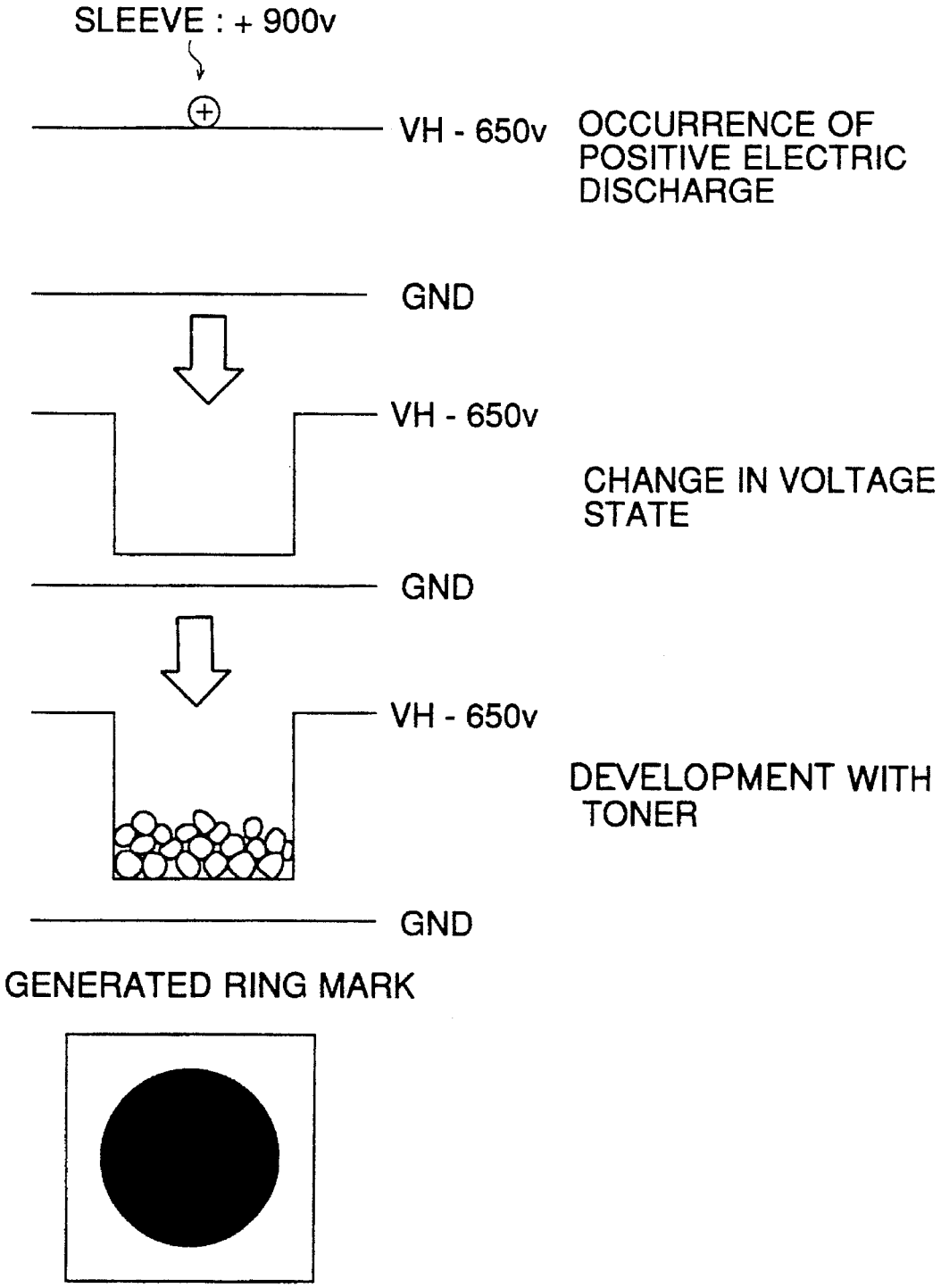
FIG. 13 is a theoretical diagram showing potential variation on the photoreceptor drum.
Figure 14:
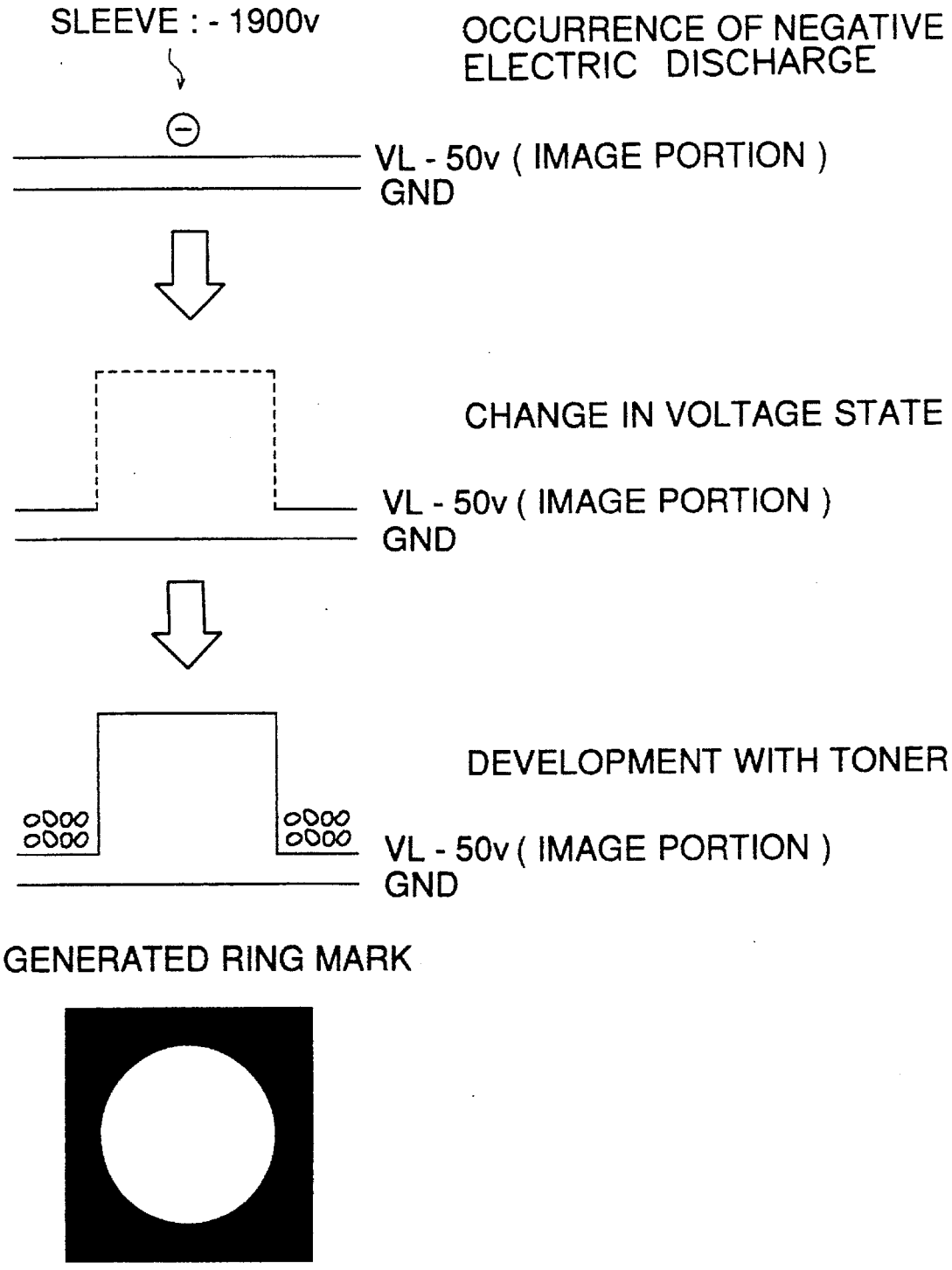
FIG. 14 is a theoretical diagram showing potential variation on the photoreceptor drum.
Figure 15:
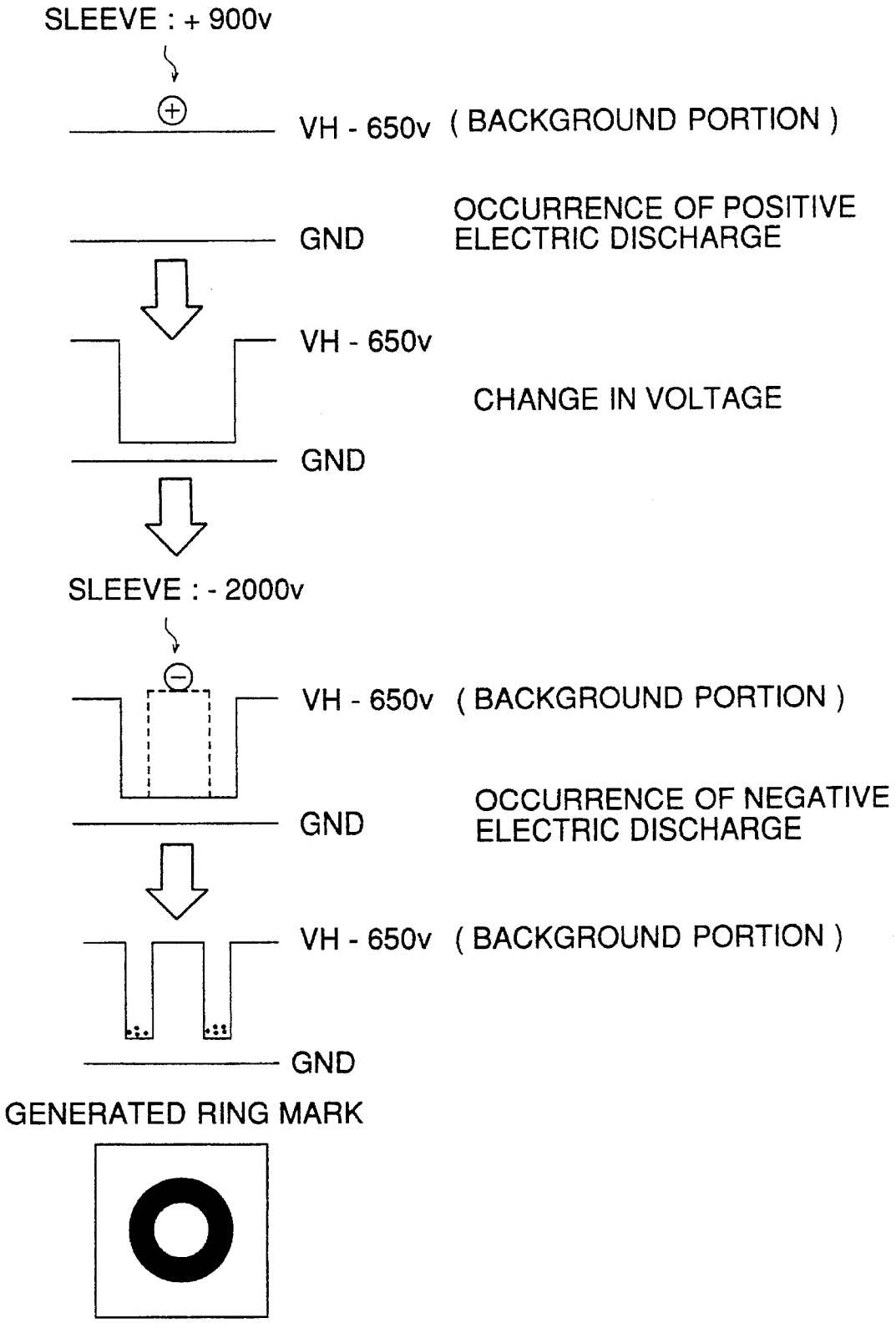
FIG. 15 is a theoretical diagram showing potential variation on the photoreceptor drum.

Next, image defects of ring marks are shown in FIG. 10. Next, the mechanism of how these image defects of ring marks are generated will be explained as follows, referring to experiment models in FIGS. 11–15. With regard to voltage on a photoreceptor drum, a background portion shows VH-650 V and an image portion shows VL-50 V after exposure as shown in FIGS. 11(*a*) and (*b*). Further, developing bias voltage is impressed as shown development model in FIGS. 12(*a*) and (*b*). Under such condition, when plus discharge takes place and thereby voltage on a photoreceptor drum is changed as shown in FIG. 13 and development is made with toner, ring marks as shown in FIG. 10(*a*) are caused. When minus discharge takes place and thereby voltage on a photoreceptor drum is changed as shown in FIG. 14 and development is made with toner, ring marks as shown in FIG. 10(*b*) are caused. Further, when voltage on a photoreceptor drum is changed by occurrence of plus discharge as shown in FIG. 15 and is further changed by occurrence of minus discharge, and development is made with toner, ring marks as shown in FIG. 10(*c*) are caused.

From the foregoing, causes for the occurrence of ring marks are as follows. In the case of development wherein alternating voltage is impressed on a developer carrier so that the maximum electric field (expression shown below) of 2.5 Mv//m or more may be formed between a photoreceptor drum which is an image carrier and a developer carrier, when conductive powder (size: 0.1–0.4 mm) passes through the narrow clearance (0.4–0.6 mm), ionization is caused in the clearance between the photoreceptor drum that is an image carrier and the tip of powder, and thereby a latent image is destroyed and ring-shaped or disk-shaped (spotlike) latent image defects are formed. When AC voltage value is large, the clearance is narrow, and powder is large, ring marks tend to appear or they have a tendency to become serious defects.

How to obtain the maximum electric field will be explained as follows.

When assuming that voltage between two points is K[V] and a distance between the two points is d[m], electric field E between the two points is given by the following equation.

$$E=K/d\ [V/m] \tag{1}$$

Voltage applied on the developing clearance Dsd is almost represented by the following expression.

$$(Vp-p/2)+|VDC|$$

From the equation (1), therefore, electric field applied on the developing clearance Dsd can be expressed in the following expression $$\{(Vp-p/2)+|VDC|\}/Dsd \tag{2}$$

Figure 16:
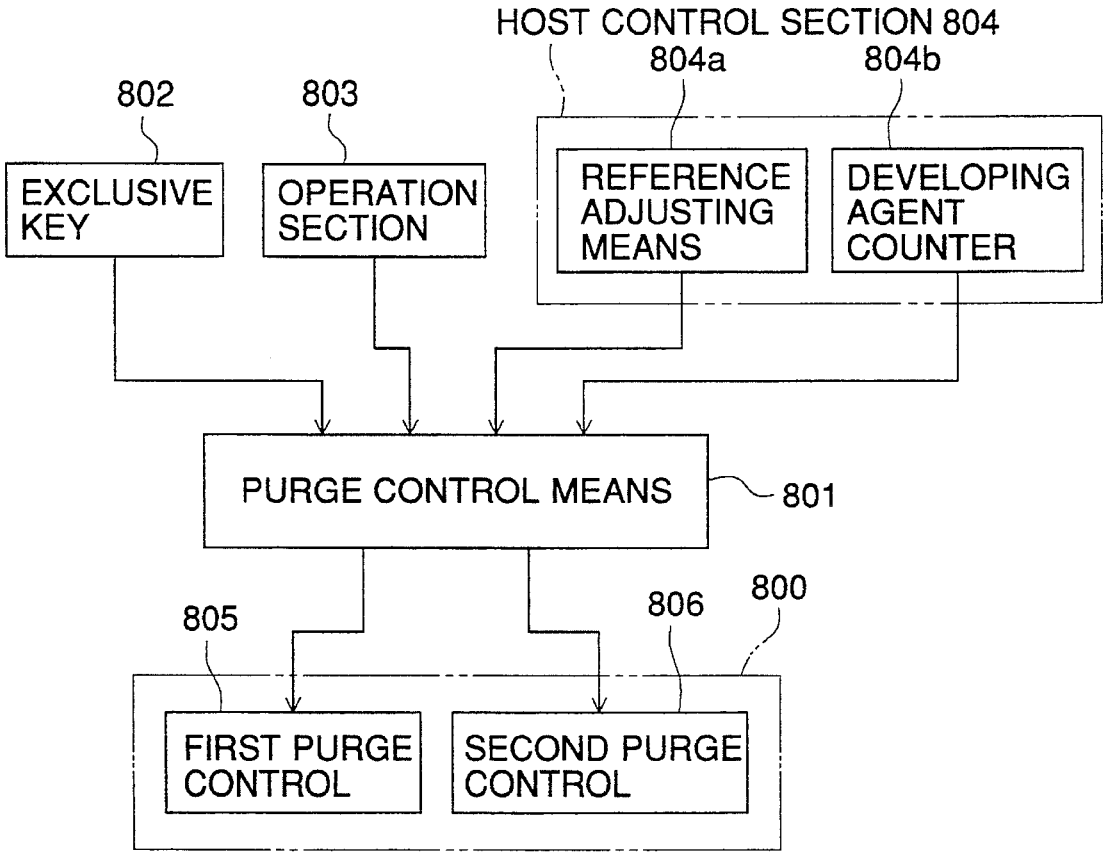
FIG. 16 is a schematic structural diagram of a special step that selectively ejects foreign matters existing in the developing unit from a developing agent carrier to an image carrier.

In the present color image forming apparatus, it is possible to remove foreign matters positively from the apparatus, and FIG. 16 is a schematic structural diagram of a specific process for ejecting selectively foreign matters existing in a developing unit from a developer carrier to an image carrier.

The concrete method for selectively ejecting the foreign matters from the developer carrier, in the specific process, will be explained later.

The color image forming apparatus is equipped with purge control means 801 that executes specific process 800 which ejects selectively foreign matter existing in developing unit 10 from developer carrier 11 to image carrier 1, and this purge control means 801 executes specific process 800 through predetermined signals from exclusive key 802, operation panel 803 or host control section 804. The specific process 800 is provided with a first purge control 805 executed simultaneously with reference adjustment for toner density control and with a second purge control 806 executed based on user's operation command or periodic operation command.

The first purge control 805 is purge control which requires no toner consumption for giving top priority to reference adjustment for toner density control when replacing developing device 100 with new one, and it removes foreign matters from developing unit 10 positively through signals from reference adjusting means 804*a* of host control section 804, so that occurrence of image defects of ring marks may be prevented.

The second purge control 806 is purge control possibly requiring toner consumption, though it is excellent in purge capability. It removes foreign matters from developing unit 10 positively through user's exclusive key 802, operation command of operation panel 803 to which a user can make access, or periodic operation command based on a developer counter, so that occurrence of image defects of ring marks may be prevented.

As stated above, there is provided specific process 800 that removes positively conductive foreign matters causing ring marks from a developing unit, and when foreign matters enter developing unit 10 and cause ring marks for some reason such as replacement of developing device 100 or transportation thereof, for example, the specific process 800 is operated to remove foreign matters from the developing unit 10 positively, so that occurrence of image defects of ring marks may be prevented.

The specific process 800 is executed through predetermined signals from exclusive key 802, operation panel 803 or from host control section 804, and is provided with a judgment control that automatically operates when a possibility of foreign matters entrance is high based on information of user operation. Namely, in the case of entrance of foreign matters, specific process 800 is operated through signals from exclusive key 802 or from operation panel 803 by user's instruction to remove the foreign matters from developing unit 10 positively, so that occurrence of image defects of ring marks may be prevented.

Further, when predetermined signals from host control section 804 indicate that a possibility of entrance of foreign matters is high, the specific process 800 is operated automatically to remove the foreign matters positively from developing unit 10, so that occurrence of image defects of ring marks may be prevented.

In the specific process 800, the image forming apparatus is set to the purge condition that the foreign matters closely related to ring marks are transferred selectively from developer carrier 11. In this example, this purge condition is that only foreign matters are transferred without transferring toner and carrier in the first purge condition, and foreign matters are transferred without transferring carrier in a risk that a little amount of toner is possibly transferred in the second purge condition.

Figure 25:
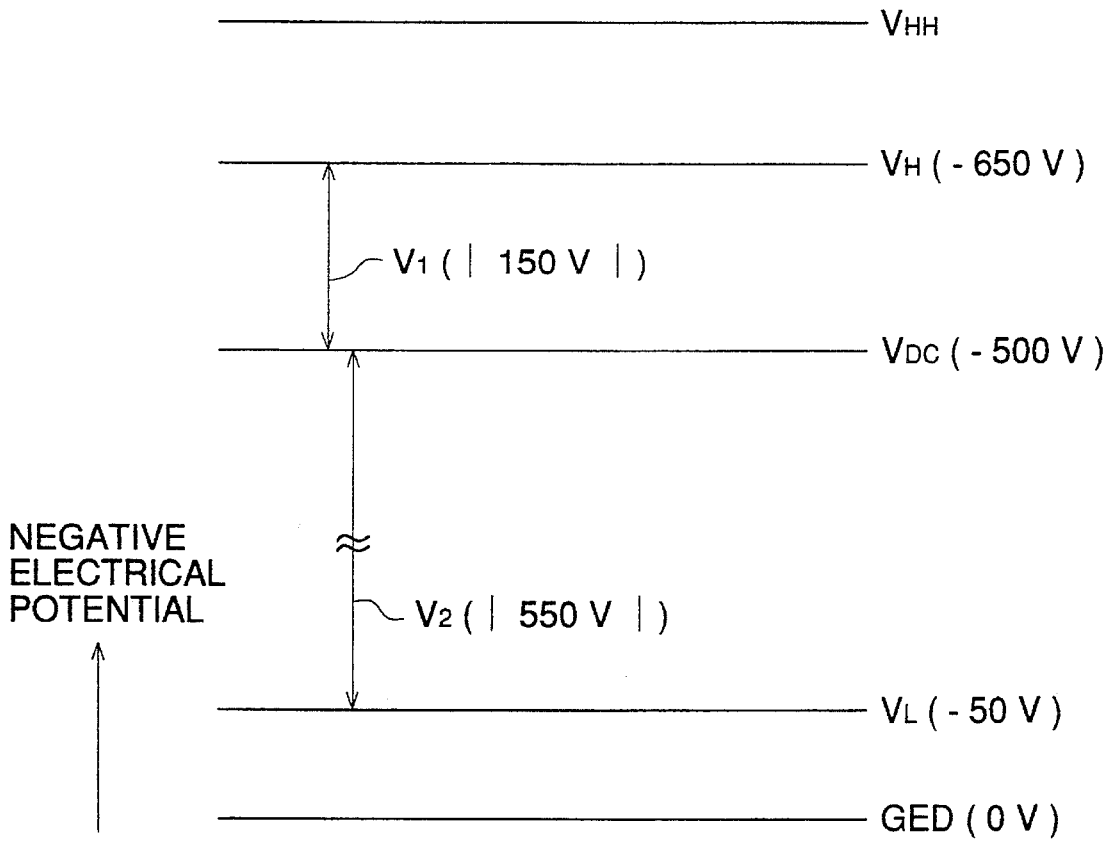
FIG. 25 shows operating conditions of the apparatus.

The concrete conditions are explained by referring FIG. 25.

The electrical potential on the photoreceptor becomes $V_H$ in a charging process and $V_L$ in an exposure process. On the other hand, DC electrical potential $V_{DC}$ on the developing sleeve is between $V_H$ and $V_L$. Normally, when AC bias is added to the aforementioned $V_{DC}$ and the electrical potential is $V_L$, toner is flown to the photoreceptor and the development is conducted. Here, it is discovered that the above-mentioned electric field affects foreign matters which are conductive. Especially, when DC electric field affects on the conductive foreign matters, electrostatic induction is caused, and charged foreign matters are transferred by DC electric field in the direction that it is becoming farther from the developing sleeve.

In the first purge control, when the electrical potential on the photoreceptor is set higher than that of the developing sleeve (In FIG. 25, it is shown that positive charged carrier and negative charged toner are used and the photoreceptor is charged to the potential at more negative side than the electrical potential of the developing sleeve.), toner is attracted to the developing sleeve side and the force to attract to the photoreceptor side works on carrier and foreign matters. Here, carrier has a strong magnetism and attractivity to the sleeve; therefore, when the electrical potential on the photoreceptor is not more than the predetermined value $V_{HH}$, carrier is not transferred to the photoreceptor.

Therefore, the electrical potential on the photoreceptor $V_H$ is set between $V_{DC}$ and $V_{HH}$, it is possible that the conductive foreign matters are selectively transferred from the developing sleeve of the developer to the photoreceptor, and the foreign matters are removed.

In the second purge control, when the electrical potential on the photoreceptor is lowered to the potential $V_L$, which is lower than the electrical potential VDC of the developing sleeve, by an exposure, carrier is attracted to the developing sleeve and is not transferred to the photoreceptor. On the other hand, electrostatic induction is caused on foreign matters, and the force to attract foreign matters to the photoreceptor side by the difference of the electrical potentials of the photoreceptor and the developing sleeve is caused. Therefore, foreign matters are transferred to the photoreceptor.

Incidentally in the second purge control, carrier is not transferred to the photoreceptor while it is done in the first purge control, it is possible to set the difference between the electrical potentials $V_L$ and $V_{DC}$ relatively large. Therefore, it is possible to transfer foreign matters from the developing sleeve to the photoreceptor by the force larger than that of the first purge control, and foreign matters are removed more actively. Moreover, even if foreign matters are the magnetic matters as such as carrier, it is possible to eject them from the developing sleeve by enough force.

Here, in the first purge control, as explained above, toner is not transferred from the developing sleeve to the photoreceptor; however, in the second purge control, toner affects on the electric field and electrostatic attraction to the photoreceptor is generated. However, as same in the normal development, when a large amount of toner is transferred to the photoreceptor, toner is consumed ineffectively, and a developing density in the developer varies; therefore, it is necessary to adjust the developing density. For this reason, in this example, when the second purge control is executed, the transfer of the toner is controlled as inactive as possible by turning off the generation of AC electric field on the contrary to developing process. By this operation, although an amount of toner may be transferred, a large amount of toner is prevented from being transferred. In other words, by controlling the electric field between the developing sleeve and the photoreceptor, both of the first and the second purge controls realize that the transfer of the carrier and toner is controlled to be inactive and the transfer of foreign matters can be selectively performed.

As explained above, the purge conditions are at least that carrier is not transferred, foreign matters are transferred, and preferably toner is not transferred. However, the concrete purge conditions vary according to the developing method. Foreign matters, transferred onto the photoreceptor 1, are collected by the cleaning unit 26; therefore, they are surely prevented from being returned to the developing unit 10 again by the cleaning unit.

Next, the timing of the first purge control conducted simultaneously with reference adjustment for toner density control will be explained in a further concrete manner as follows, referring to FIGS. 17 and 18.

The reference adjustment for toner density control is conducted when a used developing agent is replaced with a new developing agent in which toner and carrier are mixed at a preferable ratio. After that, toner density control is conducted according to the toner density of the replaced new developing agent as the reference. When a developing agent is replaced, the developing agent is stirred for a predetermined time period, the density of the developing agent is detected, and the density is stored in a memory (not shown) as a reference value. Therefore, when above-mentioned reference adjustment is conducted, the first purge control, which does not transfer toner, is executed.

Figure 17:
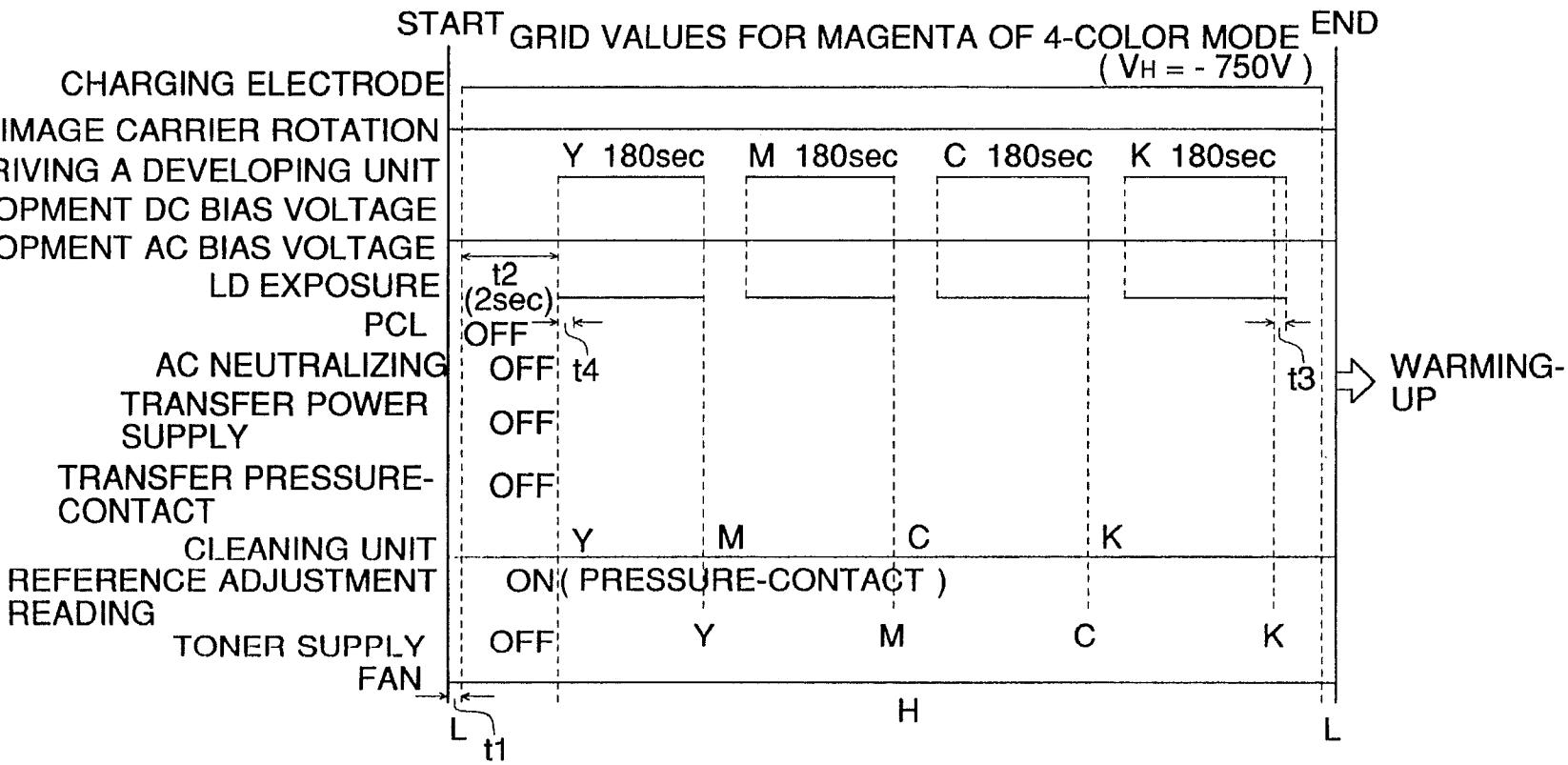
FIG. 17 is a timing chart showing a first purge control executed simultaneously with reference adjustment for simultaneous replacement of a color developing unit and a black developing unit in replacement of color developing units.

FIG. 17 is a timing chart showing the first purge control conducted simultaneously with reference adjustment for toner density control in the case of simultaneous replacement of color developing units and a black developing unit both conducted in color developing units replacement. At the start, image carrier 1 rotates, developing DC voltage is impressed, cleaning unit 26 is turned ON (pressure contact), and a fan operates. After predetermined time t 11 from the start, a charging electrode operates, and after predetermined time t 12 (2 sec.), a yellow developing unit operates, developing AC voltage is impressed and reading of reference adjustment is conducted. Next, a magenta developing unit operates, developing AC voltage is impressed and reading of reference adjustment is conducted. A cyan developing unit operates, developing AC voltage is impressed and reading of reference adjustment is conducted. Finally, a black developing unit operates and reading of reference adjustment is conducted.

When the black developing unit is operated, exposure for predetermined time t 13 in the end, namely the 1 sec. exposure is made to make a solid black image with a length of 74 mm in the circumferential direction, thus, foreign matters sticking to a cleaning blade edge portion in a cleaning unit are washed off by excessive toner supplied temporarily. When the yellow developing unit is operated, exposure for predetermined time t 14 at the start, namely the 270 msec. exposure is made to make a solid black image with a length of 20 mm in the circumferential direction, and toner is supplied to a blade edge before purging. Thus, damage of image carrier 1 caused by foreign matters can be prevented.

In the first purge control is conducted by the charged electrical potentials of developing DC bias and the photoreceptor while the developing units for Y, M, C, and K colors are being driven. In this period, foreign matters are ejected from the developing units to the photoreceptor. In this example, AC bias is applied during the developing units are working; however, it does not affect on the first purge control.

As stated above, the first purge control is conducted in parallel and simultaneously with reference adjustment for toner density control.

Figure 18:
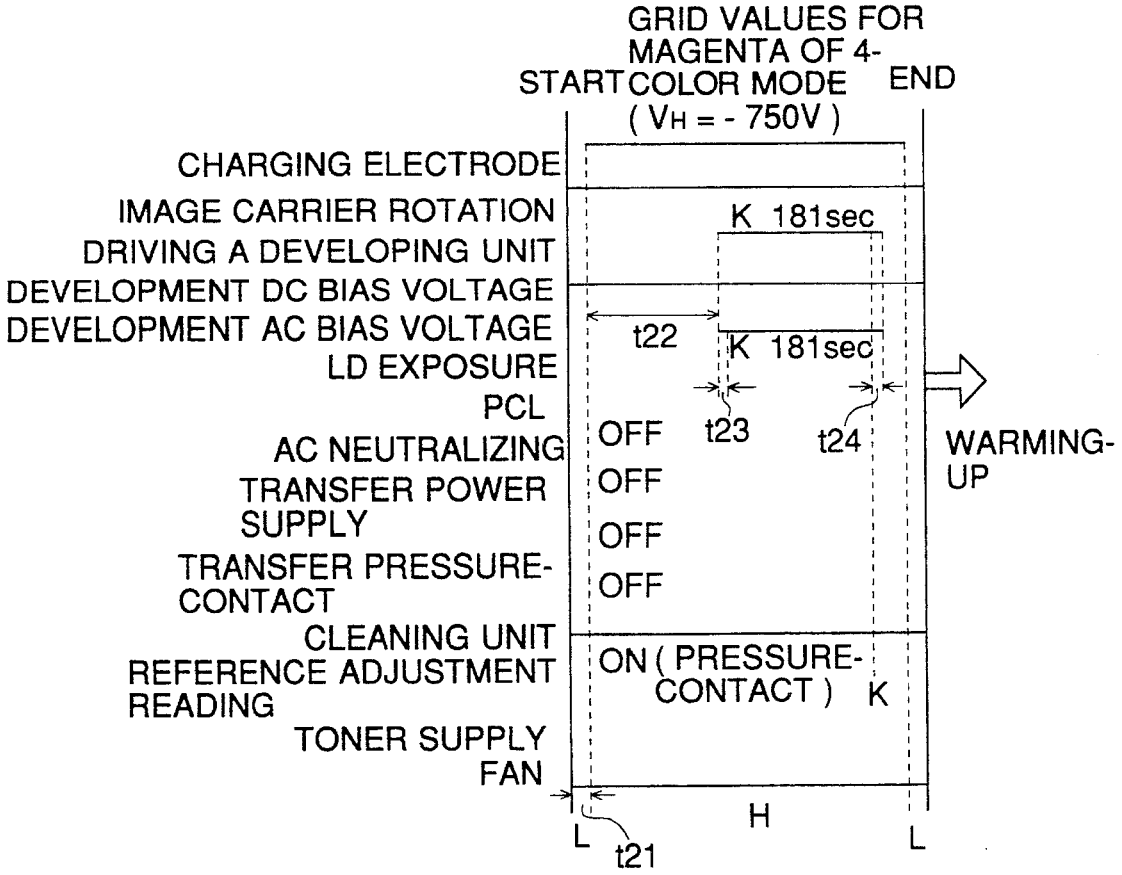
FIG. 18 is a timing chart showing the first purge control executed simultaneously with reference adjustment in replacement of a black developing unit only in replacement of color developing units.

FIG. 18 is a timing chart showing the first purge control conducted simultaneously with reference adjustment for toner density control in the case of replacement of a black developing unit in color developing units replacement. At the start, image carrier 1 rotates, developing DC voltage is impressed, cleaning unit 26 is turned ON (pressure contact), and a fan operates. After predetermined time t 21 from the start, a charging electrode operates, and after predetermined time t 22 (3 sec.), a black developing unit is operated and reading of reference adjustment is conducted.

When the black developing unit is operated, exposure for predetermined time t 23 at the start, namely the 270 msec. exposure is made to make a solid black image with a length of 20 mm in the circumferential direction, thus, foreign matters sticking to a cleaning blade edge portion are washed off by toner. At the end of operation of the black developing unit, exposure for predetermined time t 24, namely the 1 sec. exposure is made to make a solid black image with a length of 74 mm in the circumferential direction, and toner is supplied to a blade edge before purging. Thus, damage of image carrier 1 caused by foreign matters can be prevented.

In the first purge control is conducted by the charged electrical potentials of developing DC bias and the photoreceptor while the developing unit for black color is being driven. In this period, foreign matters are ejected from the developing unit to the photoreceptor.

As stated above, the first purge control is conducted in parallel and simultaneously with reference adjustment for toner density control.

Next, the second purge control conducted based on user's operation command or periodic operation command will be explained in a further concrete manner, referring to FIGS. 19 and 20.

A manner wherein foreign matters mixed in developer are caused to fly and transfer positively and selectively from developer carrier 11 to image carrier 1 will be explained, first. In the case of two-component developer utilized in the present system, carrier coated with insulating resins is charged to positive polarity in average. Toner charged on its surface to negative polarity is adsorbing electrostatically to the carrier through its image force which is owing to its own charges.

The present system is to obtain high developing capability through a manner wherein AC bias voltage is impressed on a non-contact basis and thereby toner is caused to leave the carrier attracting force zone. Under the condition that AC bias voltage is not superposed, toner can not leave the carrier attracting force zone despite a DC electric field caused by a latent image. Utilizing this point, foreign matters are transferred onto image carrier 1 selectively. Namely, due to formation of strong DC electric field on the developing clearance with which the image carrier 1 is charged to positive polarity against developer carrier 11, charges of negative polarity are injected into foreign matters by the developer carrier 11 so that the foreign matters may fly and transfer. Electrostatic force for the developer carrier 11 is applied to carrier. To toner, there is applied electrostatic force for the image carrier, but many toner particles can not leave the carrier attracting force zone.. However, some toner particles having a small amount of charges are slightly mixed, and these toner particles have low image force and transfer to image carrier 1.

Next, a concrete example is shown here.

Figure 19:
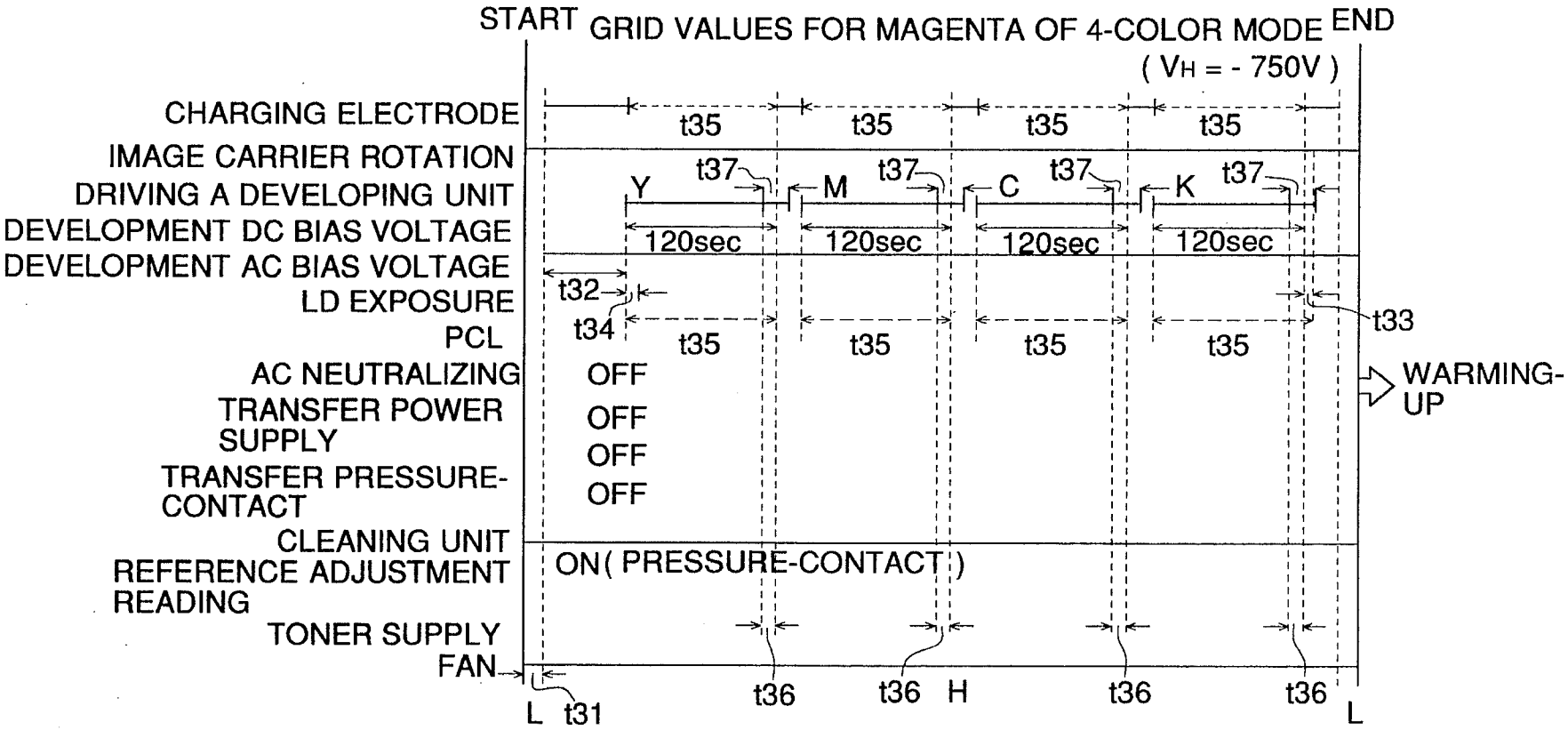
FIG. 19 is a timing chart showing the second purge control executed based on a command of a user operation or on a periodical action command in simultaneous replacement of a color developing unit and a black developing unit in replacement of color developing units.
Figure 20:
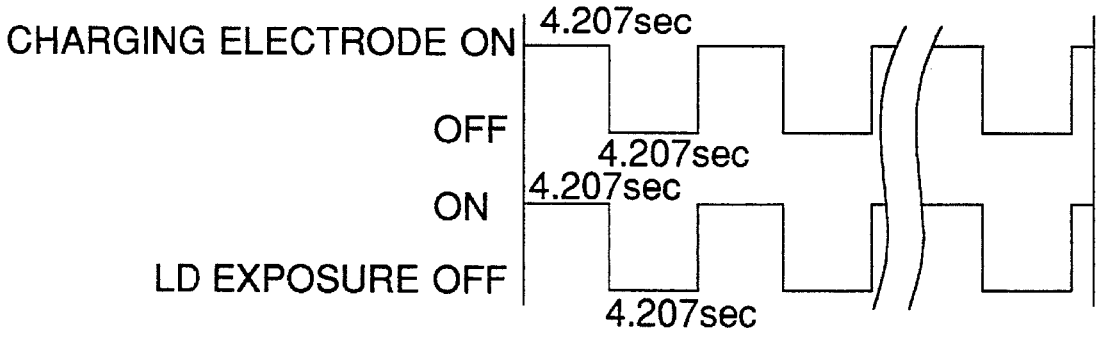
FIG. 20 is an action timing chart for a charging electrode and laser exposure.

FIG. 19 a timing chart showing the second purge control conducted based on user's operation command or periodic operation command in the case of simultaneous replacement of color developing units and a black developing unit when replacing color developing units, and FIG. 20 is a timing chart for operation of a charging electrode and laser exposure.

The reason for the foregoing is that ON/OFF needs to be controlled to advance purging while recovering fatigue of a photoreceptor, for the purpose of preventing that a memory is caused on a photoreceptor and image problems are caused immediately after the purge control when a photoreceptor is irradiated with a laser continuously. At the start, image carrier 1 rotates, developing DC voltage is impressed, patch-shaped toner adhesion is formed on image carrier 1 before purging of Y development, and toner is supplied to a cleaning blade. Cleaning unit 26 is turned ON (pressure contact) to collect the toner transferred to image carrier 1 and is sticking thereto through electrostatic force, and thereby the toner is prevented in advance from entering developing unit 10 again. Or, a fan is operated to prevent deterioration of a photoreceptor caused by generation of ozone because a charging electrode is still operating at this time. After predetermined time of t 31 from the start, a charging electrode operates, and after predetermined time of t 32 (2 sec.), a yellow developing unit operates, developing AC voltage is impressed, then, AC electric field is turned OFF, and the purging is started. Next, a magenta developing unit operates and DC bias voltage only is impressed this time, thus, purging in the magenta developing unit is conducted. Finally, a black developing unit operates and purging in the black developing unit is conducted in the same manner. In this case, each developing unit is subjected to normal purge for two minutes.

When a black developing unit operates, exposure for predetermined time of t 33 at the end, namely 1 sec laser exposure is made to make a solid black image with a length of 74 mm in the circumferential direction, thus, foreign matters sticking to a cleaning blade edge portion in a cleaning unit are washed off by excessive toner. When the yellow developing unit is operated, exposure for predetermined time t 34 at the start, namely the 270 msec. exposure is made to make a solid black image with a length of 20 mm, and toner is supplied to a blade edge portion before purging. Thus, damage on image carrier 1 caused by foreign matters is prevented.

With regard to predetermined time t 35 when a yellow developing unit a magenta developing unit, a cyan developing unit and a black developing unit are operated, a charging electrode and laser exposure are operated at timing shown in FIG. 20. Namely, each time the image carrier makes one turn, the charging electrode and laser exposure repeat ON and OFF. When laser exposure is lit for forming a developing clearance electric field which purges foreign matters constantly, light fatigue of a photoreceptor of image carrier 1 is caused on the photoreceptor after purging. On the other hand, it is also considered to turn OFF the charging constantly, but sticking to non-image area in the widthwise direction of a photoreceptor is caused. This fog toner is accumulated on both ends and outsides of a blade of a cleaning unit, resulting in a problem of toner drop from a drum unit which is feared. From the restriction mentioned above, a timing chart shown in FIG. 20 is used and both problems are not caused accordingly.

Toner is supplied at predetermined time of t 36 at the end when a yellow developing unit a magenta developing unit, a cyan developing unit and a black developing unit are operated, namely at intervals of 4 sec., and ON time for a supply solenoid for each supply is 1.340. With this toner supply, toner equivalent in terms of amount to toner sticking to image carrier 1 when purging foreign matters and lost can be supplied quantitatively. At predetermined time t 37 after a yellow developing unit a magenta developing unit, a cyan developing unit and a black developing unit are operated, namely, for 30 sec., idle rotation is conducted for stirring uniformly the toner in developing unit supplied quantitatively in purging. Due to this, original image forming state can be returned after the developer is returned to its normal state.

Figure 21:
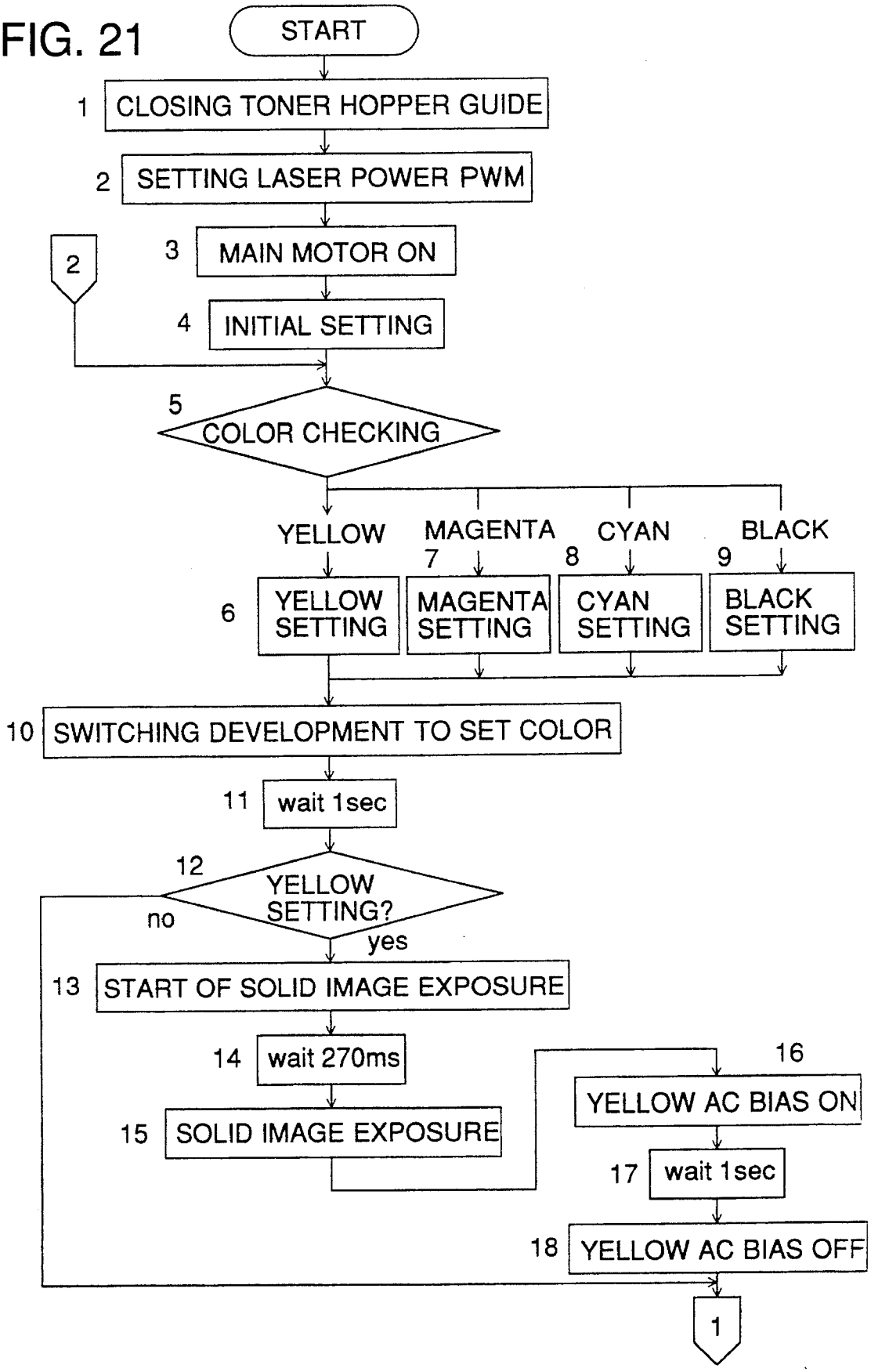
FIG. 21 is a flow chart for the second purge control.
Figure 22:
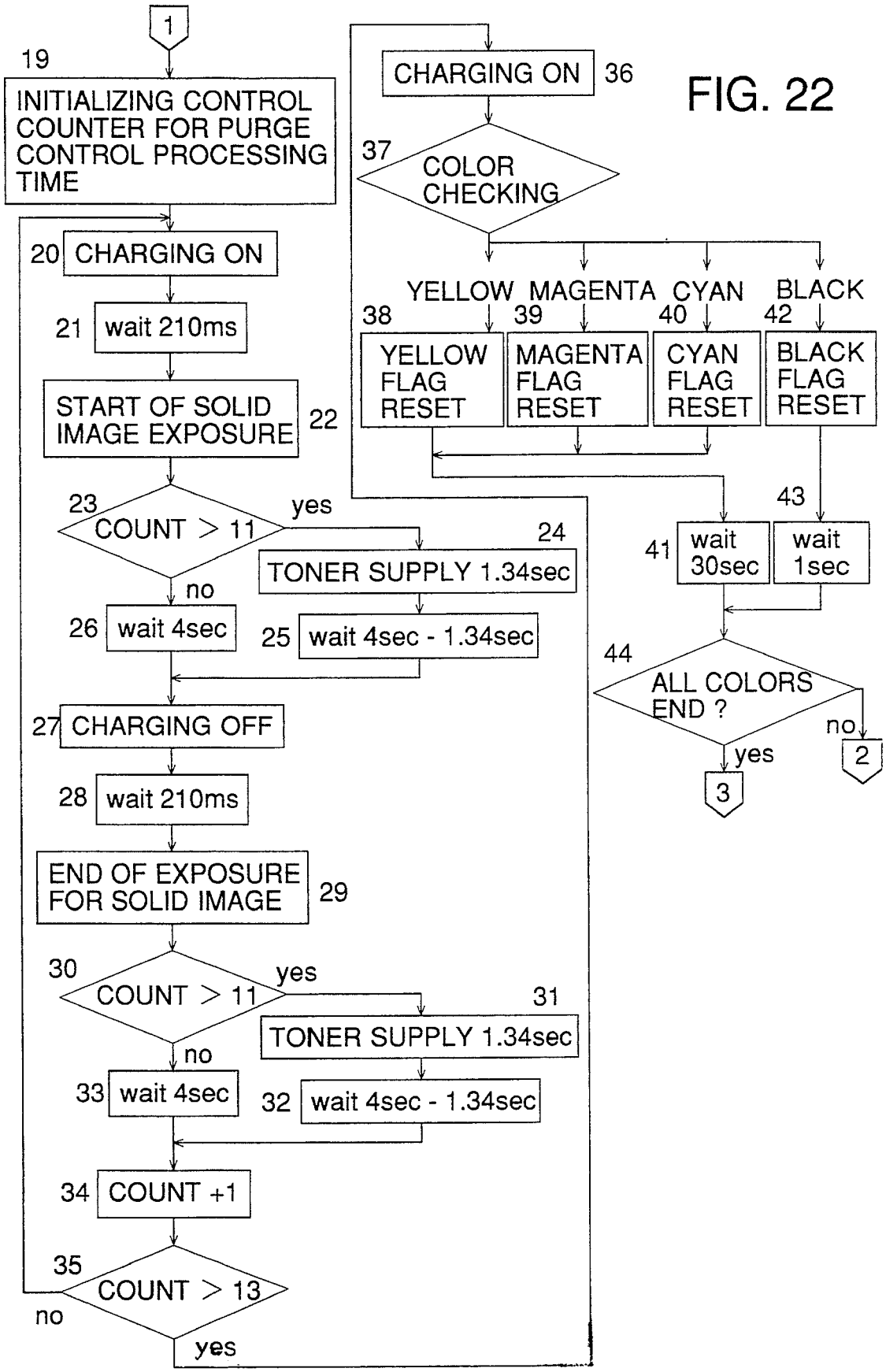
FIG. 22 is a flow chart for the second purge control.
Figure 23:
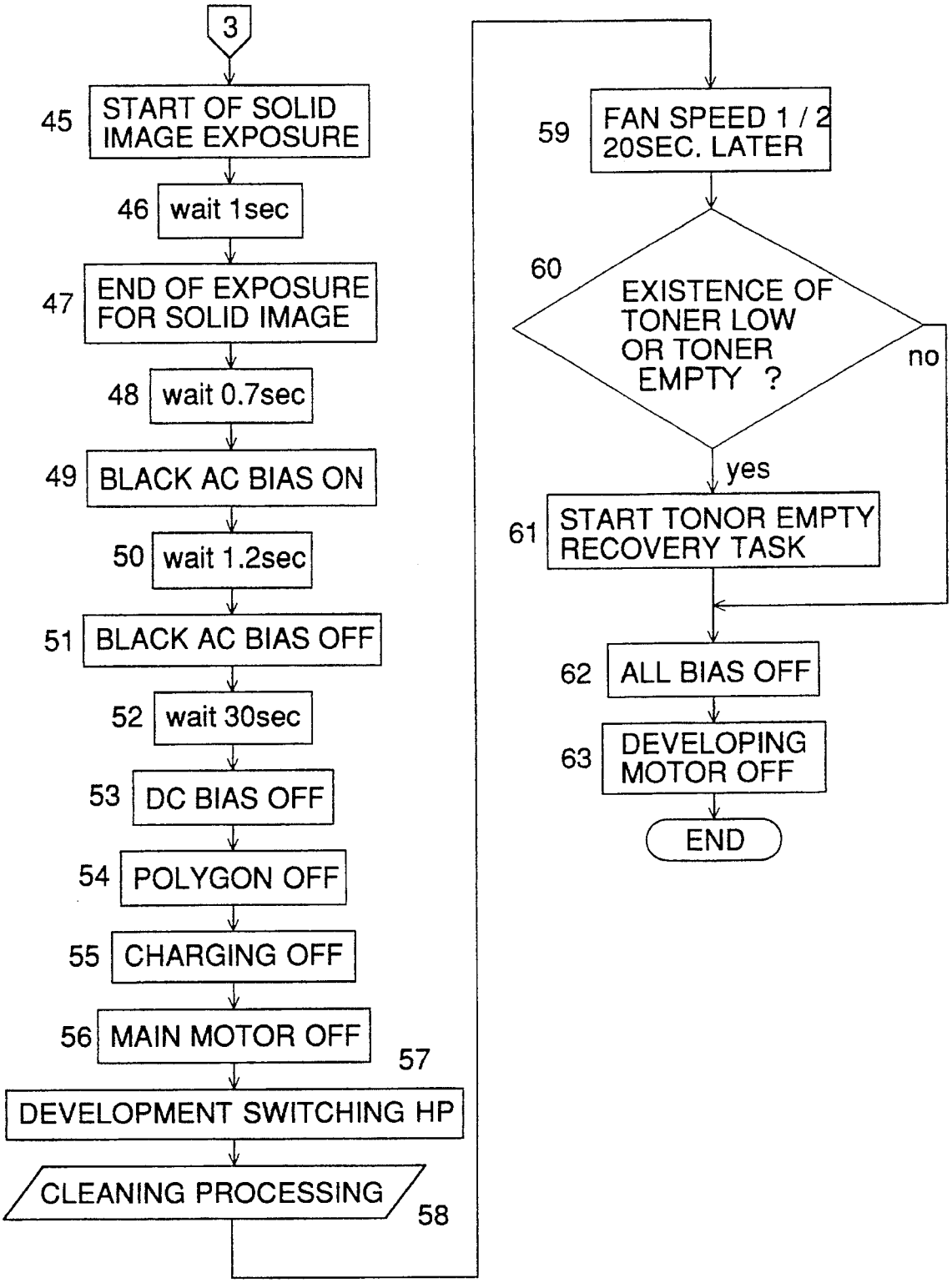
FIG. 23 is a flow chart for the second purge control.

Next, the second purge control conducted based on user's operation command or periodic operation command will be explained in a further concrete manner, referring to FIGS. 21–23. FIGS. 21–23 represent a flow chart of purge control.

The second purge control conducted based on user's operation command or periodic operation command closes a toner hopper guide (step 1) and establishes laser power and PWM (step 2). At step 3, a main motor is turned ON for initial setting (step 4), and yellow setting, magenta setting, cyan setting and black setting are conducted (steps 6–9) for color checking (step 5). Development switching to the color set is conducted (step 10), waiting time for development switching (step 11), and judgment whether or not yellow setting (step 12) are conducted, and when it is not yellow setting, the sequence moves to step 19.

In the case of yellow setting, solid image exposure is started (step 13), solid image exposure is completed (step 15), yellow AC bias is turned ON (step 16), and after 1 sec. (step 17), yellow AC bias is turned OFF (step 18). Time required from the exposure position to the yellow developing unit+α is assumed to be 1 sec.

At the step 19, a control counter for the second purge control is initialized and charging is turned ON (step 20), resulting in charging set value Vh=750. After the lapse of time of 210 msec at step 21, solid image exposure is started (step 22). 210 msec represents a time difference from a charging position to an exposure position. Judgment is made at step 23 whether the control counter for purge control time is 11 or not, and when the counter is larger than 11, toner is supplied (steps 24 and 25) and the sequence moves to step 27.. When the control counter for purge control time is smaller than 11 at step 23, after the lapse of time of 4 sec. (step 26), charging is turned OFF (step 27), and after the lapse of time of 210 msec. at step 28, solid image exposure is completed (step 29). 210 msec represents a time difference from a charging position to an exposure position.

Judgment is made at step 30 whether the control counter for purge control time is 11 or not, and when the counter is larger than 11, toner is supplied (steps 31 and 32) and the sequence moves to step 34.. When the control counter for purge control time is smaller than 11 at step 30, after the lapse of time of 4 sec. (step 33), 1 is added to the control counter for purge control time (step 34), and at step 35, judgment is made whether the control counter for purge control time is 13 or not, then, when the counter is smaller than 13, the sequence moves to step 20 to conduct the aforesaid control until the control counter for purge control time becomes larger than 13 and execution time for the second purge control is made to be two minutes.

When the control counter for purge control time is larger than 13, charging is turned ON (step 36), resulting in charging set value Vh=650. Color checking is conducted at step 37, and when the color is yellow, yellow flag is reset (step 38), while when it is magenta, magenta flag is reset (step 39), when it is cyan, cyan flag is reset (step 40) and toner distribution in a developing unit is made uniform for recovering fatigue of a drum after the lapse of time of 30 sec. (step 41). When it is black, black flag is reset (step 42) and a time difference is considered because solid images must be formed on the charged portion after the lapse of time of 1 sec. (step 43).

Judgment is made at step 44 whether all colors are completed or not, then exposure for solid image is started (step 45), and after the lapse of time of 1 sec. (step 46), exposure for solid image is completed (step 47) and black AC bias is turned ON (step 49) after the lapse of time of 0.7 sec. (step 48). Time from the exposure position to the black developing unit is 1.083 sec. Timing for ON of black bias is set to cover enough the time for the exposed portion to arrive at the black developing unit.

After the lapse of 1.2 sec. at step 50, black AC bias is turned OFF (step 51). A room of 100 msec. is needed to be given to each of the front and the rear for the width of a solid image. After the lapse of 30 sec. at step 52, DC bias is turned OFF (step 53). Toner distribution in a developing unit is made uniform for recovering fatigue of a drum A polygon is turned OFF at step 54, and charging is turned OFF (step 55), a maim motor is turned OFF (step 56), development switching is conducted (step 57), cleaning processing is conducted (step 58), a fan speed is made half, after 20 sec. (step 59), and at step 60, judgment is made whether the toner density is lowered than a prescribed value or toner is little in a toner supply unit, and when the toner density is lower than the prescribed value or when the toner supply unit is detected to be empty, the toner density is returned to the prescribed value (step 61). Then all biases are turned OFF (step 62) and a developing motor is turned OFF (step 63).

Next, purge rates of foreign matters achieved by both the first purge control conducted simultaneously with reference adjustment for toner density control and the second purge control conducted based on user's operation command or periodic operation command were tested. The results thereof are shown in Table 1.

Ten pieces of controlled metal foreign matters (aluminum, 200–800 nm) were put in a developing unit whose cleanness was checked in advance, and they were subjected to purge control made by the actual machine. After that, toner in the developing unit was filtered by a screen (80 mesh, AP177 nm) and remaining foreign matters were picked up to measure the purge effect.

TABLE 1

| | 1st | 2nd | 3rd | Average remaining number | Ejection rate |
|---|---|---|---|---|---|
| First purge control (3 min.) | 8 | 6 | 8 | 7 | 30 |
| Second purge control (1 min.) | 6 | 6 | 5 | 5.7 | 43 |
| Second purge control (2 min.) | 3 | 3 | 3 | 3 | 70 |
| Second purge control (3 min.) | 3 | 4 | 1 | 2.7 | 73 |

From Table 1, there is found that when comparing the first purge control conducted simultaneously with reference adjustment for toner density control with the second purge control conducted based on user's operation command or periodic operation command, the purge rate achieved by the second purge control is higher that of the first purge control, but foreign matters can be ejected also by the first purge control.

Figure 24:
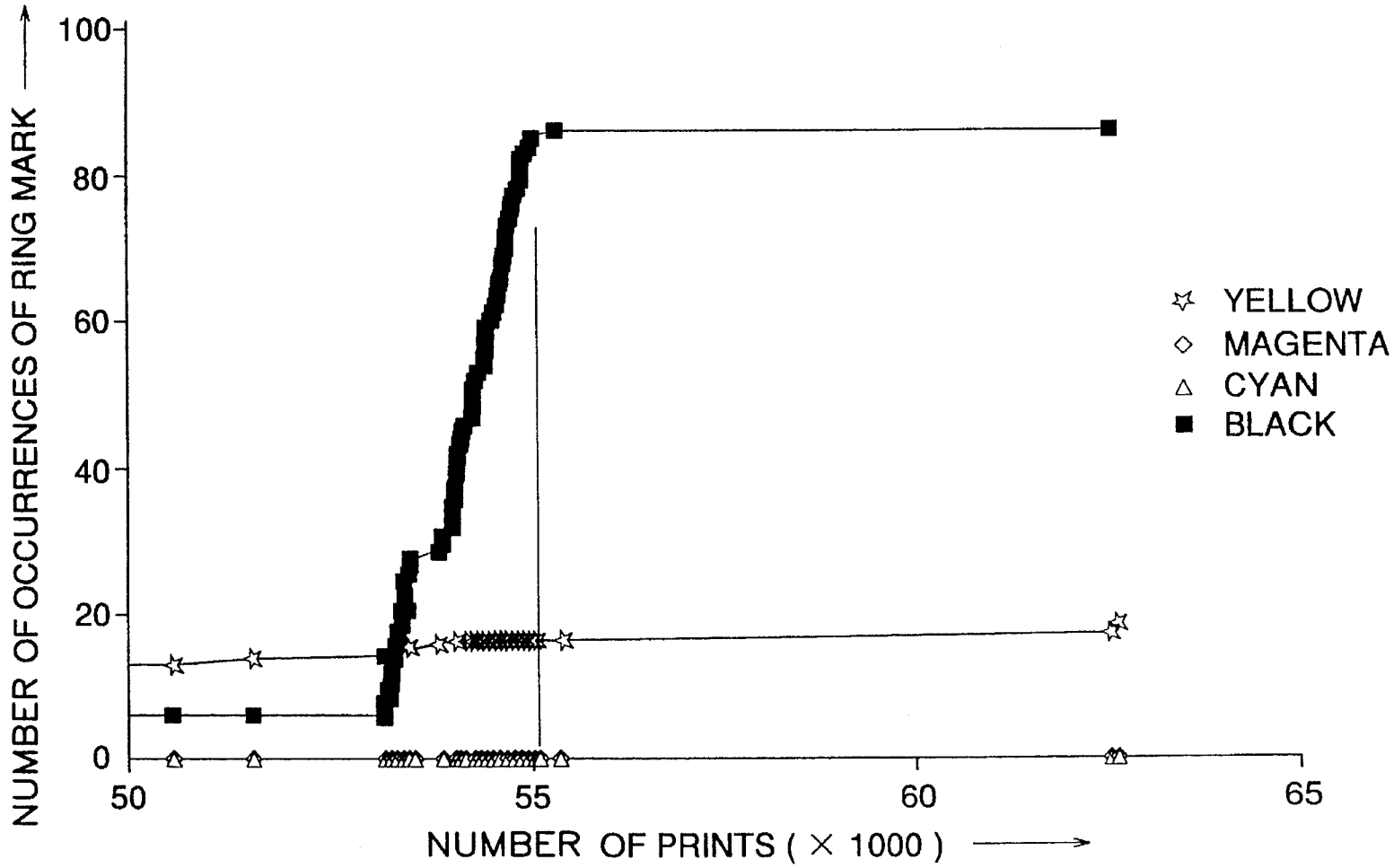
FIG. 24 is a diagram showing occurrence of ring marks caused by the second purge control executed based on a command of a user operation.

FIG. 24 is a diagram showing occurrence of ring marks caused by the second purge control conducted based on user's operation command (the vertical axis indicates a cumulative frequency). Ring marks occurring frequently from around 53000th prints disappeared from 55500 prints, due to the second purge control conducted based on user's operation command.

As stated above, in the invention, there is provided a specific process which ejects conductive foreign matters causing ring marks from a developing unit positively. Therefore, the specific process operates to eject positively the foreign matters from the developing unit to prevent occurrence of ring marks.

When an exclusive key or an operation panel by user's command or prescribed signals from host control side indicate that foreign matters are mixed, the specific process is operated to eject the foreign matters positively from a developing unit, and thereby occurrence of ring marks is prevented. Or, when a possibility of entrance of foreign matters is high, the specific process can be operated automatically to eject foreign matters from a developing unit positively and thereby to prevent occurrence of ring marks.

Since top priority is given to reference adjustment for toner density control when replacing the used developing unit with new one, the first purge control which requires no toner consumption can be conducted to eject foreign matters from a developing unit positively and thereby to prevent occurrence of ring marks.

Further, by conducting the second purge control which is conducted based on user's operation command or periodic operation command and requires toner consumption, it is possible to eject foreign matters from a developing unit positively and thereby to prevent occurrence of ring marks.

What is claimed is:

1. An image forming apparatus, comprising:

a photoreceptor for holding a latent image;

a charging device for charging said photoreceptor;

an exposure device for exposing said photoreceptor with light so as to form a latent image on said photoreceptor;

a developing unit, arranged in the vicinity of said photoreceptor, for developing said latent image with a developing agent so as to form a developing agent image on said photoreceptor, said developing unit including a developing agent holding device for holding said developing agent on a surface of said developing agent holding device;

a transfer device for transferring said developing agent image on said photoreceptor to a recording medium;

a cleaning device for cleaning residual developing agent on said photoreceptor after said developing agent image is transferred to said recording medium; and a purging device for purging foreign matter from said developing agent on said developing agent holding device, said purging device including an attraction device for attracting said foreign matter from said developing agent on said developing agent holding device by causing a difference between electric potentials of said attraction device and said developing agent holding device.

2. The apparatus of claim 1, wherein said purging device selectively removes said foreign matter from said developing agent on said developing agent holding device.

3. The apparatus of claim 1, wherein said attraction device comprises said photoreceptor, and said purging device transfers said foreign matter from said developing agent on said developing agent holding device to said photoreceptor.

4. The apparatus of claim 1, wherein said developing agent comprises a toner and a carrier.

5. The apparatus of claim 1, wherein said foreign matter comprises magnetic matter.

6. The apparatus of claim 1, wherein said purging device purges said foreign matter only at a timing other than at a timing of an image formation process of said image forming apparatus.

7. The apparatus of claim 1, wherein said attraction device comprises said photoreceptor, said purging device transfers said foreign matter from said developing agent on said developing agent holding device to said photoreceptor, and said purging device causes said difference of electric potentials by controlling said charging device to charge said photoreceptor.

8. The apparatus of claim 1, wherein said purging device causes a DC electric field between said attraction device and said developing agent holding device.

9. The apparatus of claim 8, wherein said purging device causes an AC electric field between said attraction device and said developing agent holding device.

10. The apparatus of claim 8, wherein said developing agent comprises a toner and a carrier.

11. The apparatus of claim 10, wherein said purging device causes a first difference between electric potentials of said developing agent holding device and said attraction device so that electrostatic attraction is applied on said foreign matter and said carrier in a direction from said developing agent holding device to said attraction device.

12. The apparatus of claim 11, wherein said purging device causes a second difference between electric potentials of said developing agent holding device and said attraction device so that electrostatic attraction is applied on said foreign matter and said toner in a direction from said developing agent holding device to said attraction device.

13. The apparatus of claim 12, wherein said purging device causes an AC electric field between said attraction device and said developing agent holding device except when said purging device causes said second difference of electric potentials.

14. The apparatus of claim 8, wherein:

said developing agent comprises a toner and a carrier;

said purging device causes a first difference between electric potentials of said developing agent holding device and said attraction device so that electrostatic attraction is applied on said foreign matter and said carrier in a direction from said developing agent holding device to said attraction device;

said purging device causes a second difference between electric potentials of said developing agent holding device and said attraction device so that electrostatic attraction is applied on said foreign matter and said toner in a direction from said developing agent holding device to said attraction device; and said second difference is larger than said first difference.

15. The apparatus of claim 11, wherein said first difference is determined so that at least said carrier is prevented from being transferred to said attraction device.

16. The apparatus of claim 2, wherein said purging device selectively removes said foreign matter from said developing agent on said developing agent holding device by controlling an electric field between said developing agent holding device and said attraction device.

17. The apparatus of claim 16, wherein:

said attraction device comprises said photoreceptor;

said purging device causes a DC electric field and an AC electric field between said photoreceptor and said developing agent holding device;

said purging device causes a first difference between electric potentials of said developing agent holding device and said photoreceptor so that electrostatic attraction is applied on said foreign matter and said carrier in a direction from said developing agent holding device to said photoreceptor;

said purging device causes a second difference between electric potentials of said developing agent holding device and said photoreceptor so that electrostatic attraction is applied on said foreign matter and said toner in a direction from said developing agent holding device to said photoreceptor;

said first difference is determined so that at least said carrier is prevented from being transferred to said attraction device; and said purging device controls said charging device to cause said AC electric field except when said purging device causes said second difference between electric potentials.

18. The apparatus of claim 6, wherein said purging device purges said foreign matter at a timing other than at a timing of an image formation process of said apparatus in response to a predetermined control signal.

19. The apparatus of claim 11, further comprising:

a toner density controller for controlling a density of said toner in said developing agent; and wherein said purging device causes said first difference between electric potentials when a reference toner density value, for controlling said density of said toner by said toner density controller, is adjusted.

20. The apparatus of claim 12, further comprising:

first generating means for generating an operation control signal by a manual operation; and second generating means for generating periodic control signals; and wherein said second difference between electric potentials is caused by said purging device in response to at least one of said operation control signal and said periodic control signals.

21. An image forming apparatus, comprising:

a photoreceptor for holding a latent image;

a charging device for charging said photoreceptor;

an exposure device for exposing said photoreceptor with light so as to form a latent image on said photoreceptor;

a developing unit, arranged in the vicinity of said photoreceptor, for developing said latent image with a developing agent so as to form a developing agent image on said photoreceptor, said developing unit including developing agent holding device for holding said developing agent on a surface of said developing agent holding device;

a transfer device for transferring said developing agent image on said photoreceptor to a recording medium;

a cleaning device for cleaning residual developing agent on said photoreceptor after said developing agent image is transferred to said recording medium; and a purging device for purging foreign matter from said developing agent on said developing agent holding device, said purging device including an attraction device for attracting said foreign matter from said developing agent on said developing agent holding device, said attraction device comprising said photoreceptor, and said purging device transferring said foreign matter from said developing agent on said developing agent holding device to said photoreceptor.

* * * * *